US011873451B2

(12) United States Patent
Diaz et al.

(10) Patent No.: US 11,873,451 B2
(45) Date of Patent: Jan. 16, 2024

(54) PRODUCTS FROM FCC PROCESSING OF HIGH SATURATES AND LOW HETEROATOM FEEDS

(71) Applicant: ExxonMobil Technology and Engineering Company, Annandale, NJ (US)

(72) Inventors: Cody M. Diaz, Raritan, NJ (US); Xinrui Yu, Furlong, PA (US); Timothy J. Anderson, Chatham, NJ (US); Sheryl B. Rubin-Pitel, Newtown, PA (US); Matthew H. Lindner, Washington, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/662,243

(22) Filed: May 6, 2022

(65) Prior Publication Data

US 2022/0363998 A1 Nov. 17, 2022

Related U.S. Application Data

(60) Provisional application No. 63/188,581, filed on May 14, 2021.

(51) Int. Cl.
*C10G 11/18* (2006.01)

(52) U.S. Cl.
CPC ..... *C10G 11/18* (2013.01); *C10G 2300/107* (2013.01); *C10G 2300/1074* (2013.01);
(Continued)

(58) Field of Classification Search
CPC ..... C10G 11/18; C10G 2300/107; C10G 2300/1074; C10G 2300/202;
(Continued)

(56) References Cited

U.S. PATENT DOCUMENTS 3,702,886 A 11/1972 Argauer
3,709,979 A 1/1973 Chu
(Continued)

FOREIGN PATENT DOCUMENTS

CN 102337153 A * 2/2012
CN 102337153 A 2/2012
EP 0 229 295 A2 7/1987

OTHER PUBLICATIONS

CN102337153A Description Translated (Year: 2012).*
(Continued)

*Primary Examiner* — Ellen M McAvoy
*Assistant Examiner* — Chantel Graham
(74) *Attorney, Agent, or Firm* — SHOOK, HARDY & BACON L.L.P.

(57) ABSTRACT

Compositions based on effluents and/or products from FCC processing of a high saturate content, low heteroatom content feedstock are provided. By processing a high saturate content, low heteroatom content feed under various types of FCC conditions, a variety of compositions with unexpected compositional features and/or unexpected properties can be formed. The unexpected compositional features and/or unexpected properties can correspond to features and/or properties associated with one or more of the total effluent, a naphtha boiling range portion of effluent, a distillate or light cycle oil boiling range portion of the effluent, and/or a bottoms portion of the effluent.

16 Claims, 12 Drawing Sheets

(52) U.S. Cl.
CPC . *C10G 2300/202* (2013.01); *C10G 2300/301* (2013.01); *C10G 2300/302* (2013.01); *C10G 2300/305* (2013.01); *C10G 2300/307* (2013.01); *C10G 2300/308* (2013.01)

(58) Field of Classification Search
CPC ..... C10G 2300/301; C10G 2300/302; C10G 2300/305; C10G 2300/307; C10G 2300/308; C10G 2400/02; C10L 1/04
See application file for complete search history.

(56) References Cited

U.S. PATENT DOCUMENTS

| | | | |
|---|---|---|---|
| 3,770,614 | A | 11/1973 | Graven |
| 3,832,449 | A | 8/1974 | Rosinski et al. |
| 3,948,758 | A | 4/1976 | Bonacci et al. |
| 4,016,245 | A | 4/1977 | Plank et al. |
| 4,076,842 | A | 2/1978 | Plank et al. |
| 4,229,424 | A | 10/1980 | Kokotailo |
| 4,254,297 | A | 3/1981 | Frenken et al. |
| 4,310,440 | A | 1/1982 | Wilson et al. |
| 4,440,871 | A | 4/1984 | Lok et al. |
| 4,500,651 | A | 2/1985 | Lok et al. |
| 6,793,804 | B1 | 9/2004 | Lindsay et al. |
| 7,491,315 | B2 | 2/2009 | Eng et al. |
| 8,114,678 | B2 | 2/2012 | Chawla et al. |
| 2003/0127362 | A1 | 7/2003 | Halbert et al. |
| 2010/0300932 | A1 | 12/2010 | Debuisschert et al. |
| 2015/0267130 | A1 | 9/2015 | Butley et al. |
| 2017/0183575 | A1 | 6/2017 | Rubin-pitel et al. |
| 2020/0140763 | A1* | 5/2020 | Dreux ..... B01J 29/084 |

OTHER PUBLICATIONS

Ohmes, R., and Lehr, M., "Impact of light tight oils on distillate hydrotreater operation", KBC Advanced Technologies, pp. 1-11 (2016).

Bryden, K., et al., "Catalytic solutions for processing shale oils in the FCC", Grace Catalyst Technologies, pp. 1-6 (2014).

International Search Report and Written Opinion received for PCT Patent Application No. PCT/US2022/072148, dated Oct. 14, 2022, 14 pages.

* cited by examiner

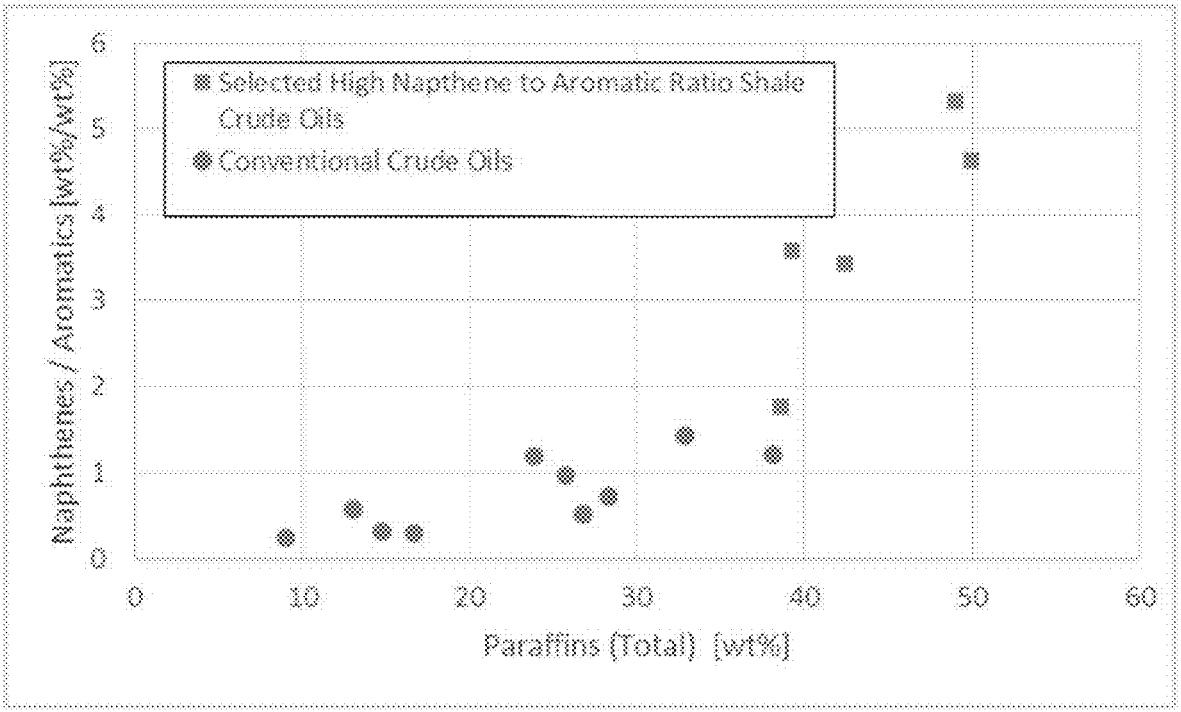
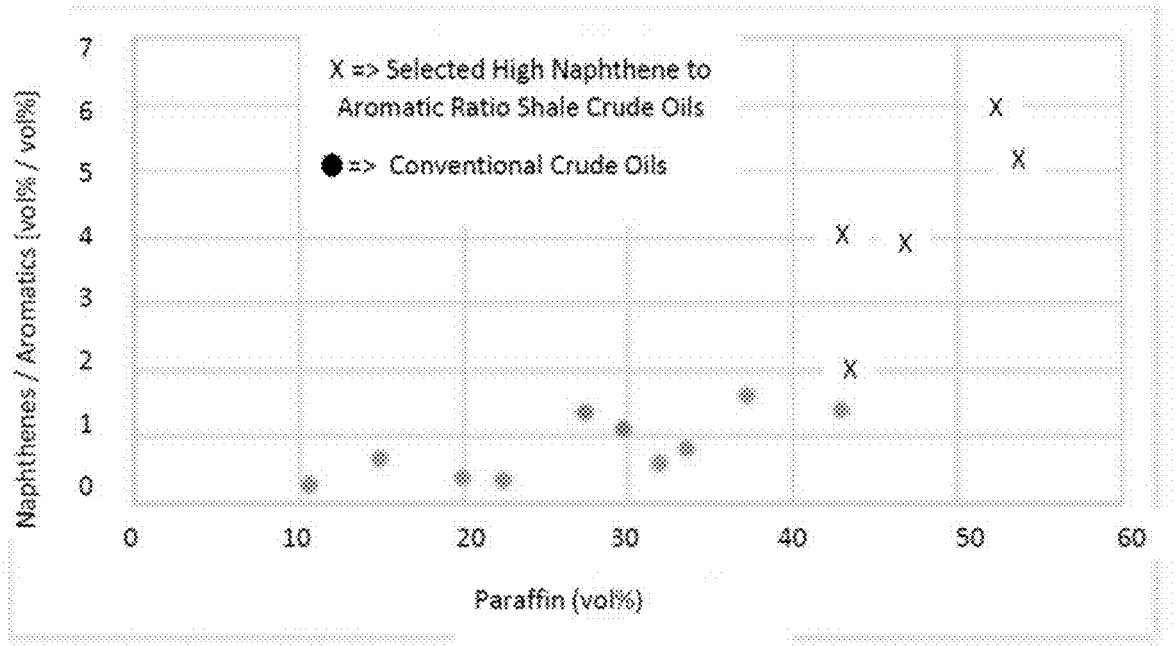
FIG. 5

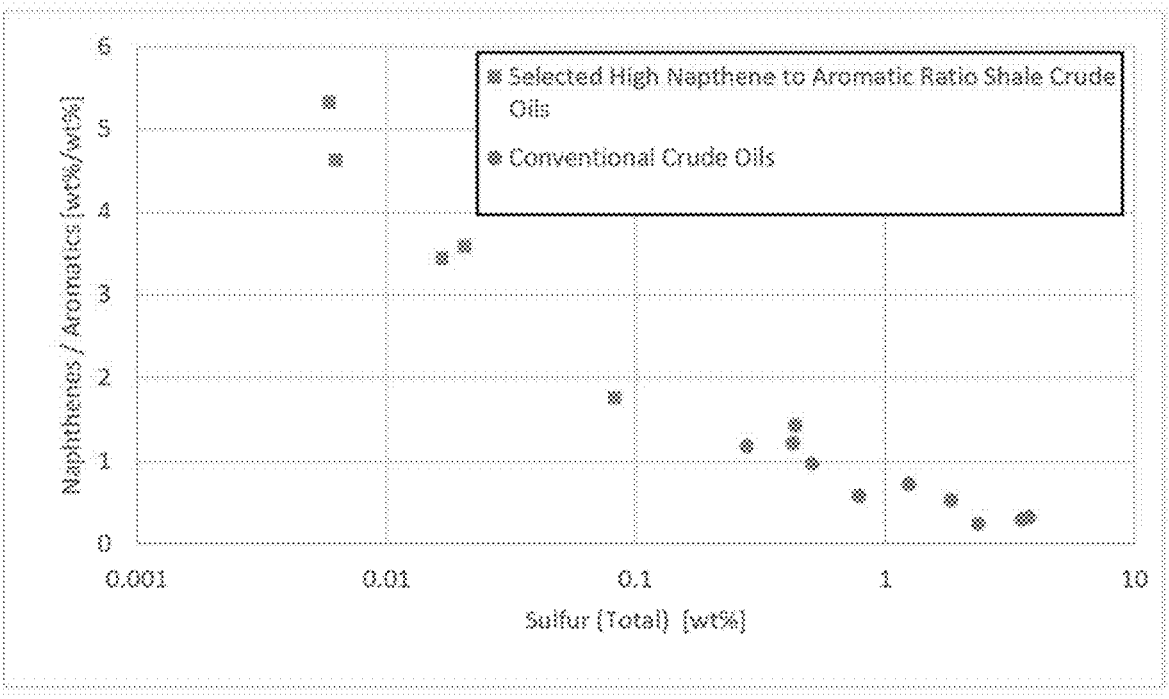
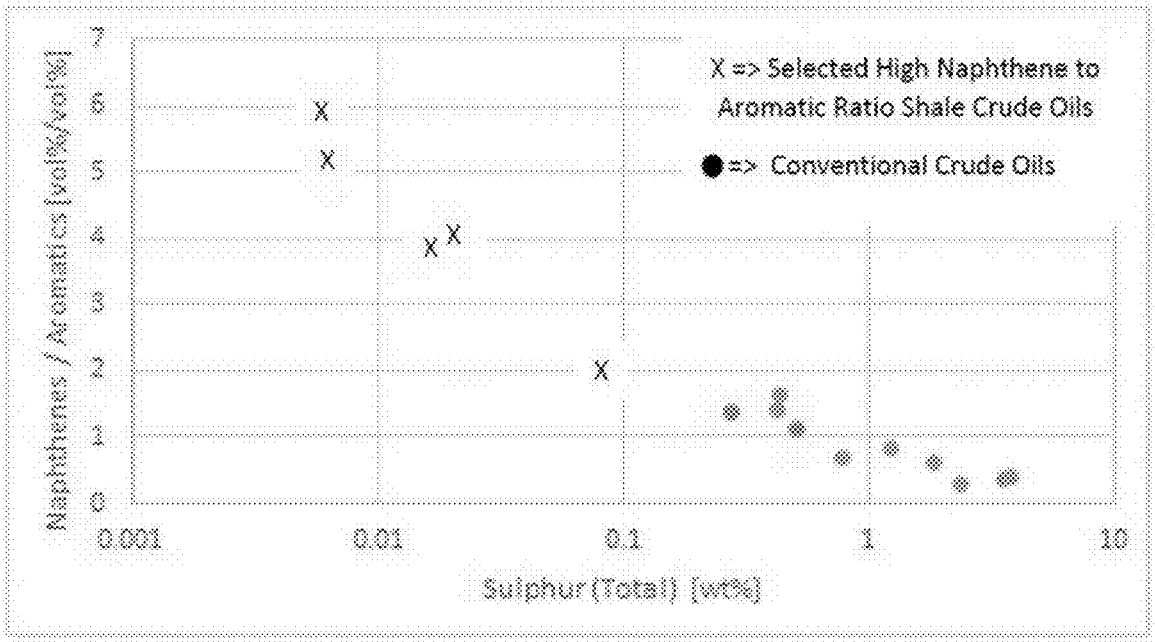
FIG. 6

| Distillate (430-650°F) | A | B | C | D | ECA ISO8217 DMA |
|---|---|---|---|---|---|
| Total Naphthenes wt% (less olefins) | 8.8 | 7.2 | 16.5 | 10.2 | |
| Total Saturates wt% (Paraffins plus naphthenes less olefins) | 26.4 | 24.5 | 35.9 | 34.8 | |
| Total Cyclics wt% (Aromatics plus naphthenes less olefins) | 79.1 | 82.8 | 70.6 | 65.5 | |
| Napthenes/Aromatics, wt/wt | 0.125 | 0.095 | 0.305 | 0.184 | |
| Paraffins/Aromatics wt/wt | 0.250 | 0.229 | 0.359 | 0.445 | |
| Saturates/Aromatics wt/wt | 0.376 | 0.324 | 0.664 | 0.629 | |
| Paraffins/Saturates wt/wt | 0.667 | 0.706 | 0.540 | 0.707 | |
| Paraffins/Cyclics wt/wt | 0.223 | 0.209 | 0.275 | 0.376 | |
| Oxidation Induction: Time to Pressure Drop, min | 625 | 184 | 746 | 115 | |
| Total Acid Number, mgKOH/g | 0.12 | 0.26 | 0.00 | 0.04 | ≤0.5 |
| Max Acid Number, mgKOH/g | 0.12 | 0.03 | <0.01 | <0.01 | |
| Kinematic Viscosity (40 °C) mm2/s | 2.397 | 2.569 | 3.274 | 3.018 | 2 - 6 |
| Cloud Point, °C | -22 | -27 | -17 | -12 | Report |
| Pour Point, °C | -27 | -38 | -17 | -13 | |
| Cold Filter Plugging Point, °C | -22 | -24 | -15 | -11 | Report |
| Centane Index (ASTM D976) | 33.5 | 26.6 | 37.6 | 38.4 | |
| Cetane Index Delta After Hydrotreating (ASTM D976), Modeled | +6.1 | | +5.8 | | |
| Centane Index (ASTM D4737 Procedure A) | 32.6 | 26.5 | 37.0 | 40.7 | ≥40 |
| Cetane Index Delta After Hydrotreating (ASTM D4737), Modeled | +6.4 | | +6.8 | | |
| Centane Index (ASTM D4737 Procedure B) | 29.3 | 18.9 | 35.1 | 38.2 | |
| Corrosion of Cu by Petroleum, 150°C, 3 Hrs | 1B | 1B | 2C | 2B | |
| Density (15.6C), kg/m$^3$ | 917 | 926 | 895 | 883 | ≤890 |
| Distillate Fuel Net Specific Energy (MJ/kg) (correlation) | 41.7 | 42.0 | 41.8 | 42.3 | |
| Volumetric heating value (MJ/L) (correlation) | 38.3 | 37.6 | 38.7 | 37.4 | |
| Wax Endpoint Temp, °C (Based on DSC) | -12 | -13 | -6 | 0 | |
| Meets Tested ISO8217 DMA Limits* *Not the complete spec | No | No | No | Yes | |

A and C: Conventional Feed B and D: High Saturates / Low Heteroatom Feed

A and B: High Severity (C/O ratio ~10.5) C and D: Low Severity (C/O ratio ~ 5.0)

FIG. 12

| Feed Description | Commercial FCC Feed | High Saturate Feed | Commercial FCC Feed | High Saturate Feed |
|---|---|---|---|---|
| RTT, °F | 980 | 980 | 980 | 980 |
| C/O, g/g | 10.7 | 10.3 | 5.1 | 4.9 |
| | | | | |
| **Bottoms (650°F-FBP)** | | | | |
| Density, g/cc | 1.063 | 1.013 | 0.938 | 0.904 |
| HDT Density, g/cc | | | | |
| Total Sulfur, wt% | 1.620 | 0.204 | 0.925 | 0.107 |
| Aliphatic Sulfur, wppm | - | 0.065 | 0.082 | 0.058 |
| Aliphatic Sulfur to Total Sulfur Ratio, wt/wt | - | 0.32 | 0.09 | 0.54 |
| HDT Aliphatic Sulfur to Total Sulfur Ratio, wt/wt | <0.001 | - | <0.001 | - |
| Nitrogen, wppm | 2536 | 518 | 1791 | 346 |
| Hydrogen, wt% | 8.09 | 9.46 | 11.19 | 12.19 |
| M1567, wt% (°F) | | | | |
| 5 | 648 | 662 | 650 | 653 |
| 10 | 666 | 676 | 669 | 671 |
| 50 | 753 | 757 | 760 | 744 |
| 90 | 873 | 877 | 881 | 877 |
| 95 | 914 | 915 | 924 | 917 |
| Olefins, wt% | None detected by NMR | None detected by NMR | None detected by NMR | None detected by NMR |
| Kinematic Viscosity by Stabinger, $mm^2/s$ | | | | |
| KV (40°C) | | 197.810 | | 27.210 |
| KV (60°C) | 51.085 | | 14.696 | |
| KV (100°C) | 9.078 | 9.334 | 5.017 | 4.527 |
| KV (50°C) (Calculated) | 96.27 | 94.77 | 21.18 | 18.15 |
| MCRT, wt% | 3.36 | | 1.00 | 0.58 |
| n-C7 Insolubles, wt% | 0.58 | 0.42 | 2.40 | 0.28 |
| STAR7, wt% | | | | |
| Saturates | 15.1 | 27.3 | 38.6 | 54.8 |
| Aromatics | 81.5 | 72.70 | 61.40 | 45.20 |
| ARC1 | 0.9 | 0.9 | 3.4 | 1.0 |
| ARC2 | 4.8 | 3.3 | 5.2 | 1.9 |
| ARC3 | 33.9 | 30.2 | 16.2 | 12.7 |
| ARC4 | 41.9 | 36.0 | 34.9 | 26.7 |
| Saturates/Aromatics | 0.185 | 0.376 | 0.629 | 1.212 |

FIG. 13

| Feed Description | Commercial FCC Feed | High Saturate Feed | Commercial FCC Feed | High Saturate Feed |
|---|---|---|---|---|
| RTT, degF | 980 | 980 | 980 | 980 |
| C/O, g/g | 10.7 | 10.3 | 5.1 | 4.9 |
| | | | | |
| **Bottoms (650°F-FBP)** | | | | |
| SBN | | | 96 | 85 |
| CCAI | 942.6 | 887.6 | 839.9 | 806.9 |
| BMCI [SBN Surrogate](Used BP and density) | 119.4 | 95.7 | 59.7 | 44.8 |
| BMCI to Total Sulfur Ratio | 73.7 | 469.1 | 64.5 | 418.7 |
| HDT BMCI [SBN Surrogate](Used BP and density) | 76.6 | - | 34.0 | - |
| Density (15°C), kg/m$^3$ | 1063 | 1013 | 938 | 904 |
| Residual Fuel Net Specific Energy (MJ/kg) (correlation) | 39.6 | 40.8 | 41.6 | 42.3 |
| Volumetric heating value (MJ/L) (correlation) | 42.1 | 41.3 | 39.0 | 38.2 |
| No Flow Point, °C | 20.5 | -6.4 | 34.3 | 18.2 |
| Wax Endpoint Temp, °C (Based on DSC) | 75 | 70 | 60 | 77 |
| Meets Tested ISO8217 RME 180 Limits* **Not the complete spec* | No | No | No | Yes |

FIG. 14

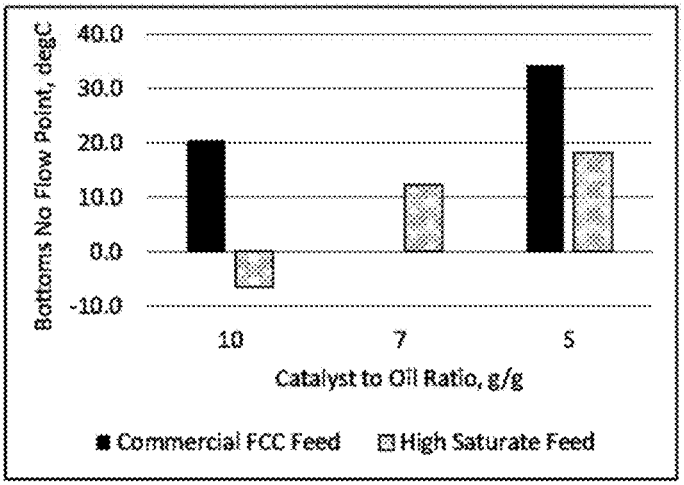

FIG. 15

| FEED DESCRIPTION | Commercial FCC Feed | High Saturate Feed | Commercial FCC Feed | High Saturate Feed |
|---|---|---|---|---|
| TEMPERATURE, °F | 980 | 980 | 980 | 980 |
| C/O, g/g | 10.7 | 10.3 | 5.1 | 4.9 |
| 430°F+ CONVERSION, wt% | 73.6 | 88.8 | 54.6 | 79.4 |
| | | | | |
| NORMALIZED YIELDS, WT% ON FEED | | | | |
| Gasoline ($C_5$-430°F) | 52.2 | 64.8 | 40.7 | 61.7 |
| Coke yield | 5.92 | 3.13 | 3.31 | 1.61 |
| LCO (430-650°F) | 17.92 | 8.28 | 23.00 | 11.13 |
| LPG ($C_3$, $C_4$) | 13.63 | 19.75 | 8.77 | 15.02 |
| Dry gases ($H_2$+$C_1$+$C_2$+$H_2S$) | 1.85 | 1.10 | 1.79 | 1.04 |
| Dry gases ($H_2$+$C_1$+$C_2$) | 1.53 | 1.10 | 1.51 | 1.04 |
| Total $C_2$'s | 0.81 | 0.63 | 0.85 | 0.62 |
| Total $C_3$'s | 4.44 | 6.04 | 3.08 | 4.54 |
| Total $C_4$'s | 9.19 | 13.71 | 5.70 | 10.48 |
| $C_4$= / Total $C_4$'s | 0.62 | 0.62 | 0.69 | 0.68 |
| $C_3$= / Total $C_3$'s | 0.83 | 0.85 | 0.82 | 0.86 |
| $C_2$= / Total $C_2$'s | 0.51 | 0.57 | 0.50 | 0.55 |
| $H_2$ | 0.16 | 0.09 | 0.13 | 0.07 |
| $H_2S$ | 0.32 | 0.00 | 0.28 | 0.00 |
| $CH_4$ | 0.55 | 0.38 | 0.53 | 0.35 |
| $C_2$ | 0.39 | 0.27 | 0.42 | 0.27 |
| $C_2$= | 0.42 | 0.36 | 0.43 | 0.34 |
| $C_3$ | 0.77 | 0.90 | 0.56 | 0.66 |
| $C_3$= | 3.68 | 5.14 | 2.51 | 3.88 |
| $iC_4$ | 2.83 | 4.37 | 1.38 | 2.70 |
| $nC_4$ | 0.67 | 0.91 | 0.39 | 0.61 |
| $iC_4$= | 1.26 | 1.89 | 1.03 | 1.84 |
| $nC_4$= | 4.42 | 6.55 | 2.90 | 5.34 |
| $C_4$= | 5.68 | 8.44 | 3.93 | 7.18 |
| Bottoms (650°F+) | 8.5 | 2.9 | 22.4 | 9.5 |

FIG. 16

PRODUCTS FROM FCC PROCESSING OF HIGH SATURATES AND LOW HETEROATOM FEEDS

CROSS REFERENCE TO RELATED APPLICATIONS

This application claims priority to and the benefit of U.S. Ser. No. 63/188,581 filed on May 14, 2021, the entire contents of which are incorporated herein by reference.

FIELD

This disclosure relates to FCC processing of feedstocks including high paraffin and naphthene contents while also having low contents of heteroatoms different from carbon and hydrogen, and the resulting products from FCC processing of such feeds.

BACKGROUND

Fluid catalytic cracking (FCC) is a common refinery process for converting vacuum gas oil boiling range fractions and/or fractions including a limited amount of 566° C.+ components to form a variety of lower boiling products. Such products can include naphtha boiling range fractions and diesel boiling range fractions. Historically, at least a portion of the value of FCC processing has been based on the ability of FCC processing to convert heavier feeds into fuels boiling range fractions at high yields without requiring addition of a hydrogen ($H_2$) stream to the processing environment.

While FCC processes remain useful for increasing the production of fuels boiling range products, challenges remain for improving the overall product slate generated from FCC processing. For example, in addition to the naphtha and diesel boiling range fractions, FCC processing also results in production of other product fractions. One additional product fraction is a light ends fraction. The saturated portion of the light ends product ($C_{4-}$) is relatively low value. Thus, one option for improving an FCC process can be to reduce or minimize the amount of saturated light ends produced during an FCC process. However, to the degree that the content of $C_3$ and $C_4$ olefins (and optionally $C_2$ olefins) can be increased, such olefins can be separated from the light ends for use in a variety of high value applications, such as polymer formation, alkylation and/or naphtha reforming.

Another additional product fraction is a bottoms fraction, which is sometimes referred to as a catalytic slurry oil or main column bottoms. Historically, the bottoms from an FCC process has been a low value fraction with limited disposition options. One of the few readily available dispositions has been incorporation of FCC bottoms into marine fuel oils. However, based on recent regulatory activity in various jurisdictions to reduce or minimize sulfur limits on marine fuel oils, even this disposition will become increasingly difficult to take advantage of. Thus, one option for improving an FCC process can be to reduce or minimize production of FCC bottoms. Conventionally, however, the FCC processing conditions that result in reduced or minimized production of FCC bottoms can tend to correspond to conditions that result in an increase in light ends production, and vice versa. Additionally or alternatively, improvements to the quality of the FCC bottoms that would increase the options for incorporating the FCC bottoms into higher value products would also be beneficial.

In addition to reducing or minimizing yields of lower value products, improvements would also be desirable in the quality of the target products. For example, the naphtha fraction generated by an FCC process can generally be high in research octane value (RON) and/or motor octane value (MON). However, because FCC naphtha fractions are derived from a higher boiling range feed, the sulfur content of the resulting FCC naphtha fractions can be too high for direct incorporation into a gasoline pool. As a result, such naphtha fractions are typically exposed to additional processing, such as hydroprocessing, to reduce the sulfur level. While this is effective, the additional sulfur processing typically also results in a reduction in the RON and/or MON for the resulting reduced sulfur naphtha product. Additionally, a substantial portion of the octane value can come from the aromatics content of the FCC naphtha fraction. A variety of regulations around the world are focused on limiting the aromatics content of gasoline products. Thus, it would be desirable to reduce or minimize the sulfur and/or aromatics content of FCC naphtha while still retaining a substantial portion of the relatively high RON and/or MON values typically associated with FCC naphtha.

U.S. Pat. No. 6,793,804 describes severe hydrotreating of a potential FCC feed prior to introduction into an FCC unit, so that the resulting FCC naphtha products can have a reduced or minimized sulfur content. Diesel formed by conversion of the potential FCC feed during the severe hydrotreating can be exposed to a second hydrotreating stage to form a diesel boiling range fraction with a reduced or minimized sulfur content.

U.S. Pat. No. 7,491,315 describes FCC processing of light (Cu or less) olefinic or paraffinic feeds at high temperatures in order to increase production of olefins.

An article titled "Impact of Light Tight Oils on Distillate Hydrotreater Operation" in the May 2016 issue of Petroleum Technology Quarterly describes hydroprocessing of kerosene and diesel boiling range fractions derived from tight oils.

An article titled "Catalytic solutions for processing shale oils in the FCC" published in the April 2014 issue of Digital Refining describes processing considerations, including catalyst choices, for FCC processing of shale oils. The shale oil feeds described in the article include roughly 60 wt % of saturates.

U.S. Patent Application Publication 2017/0183575 describes fuel compositions formed during hydroprocessing of deasphalted oils for lubricant production.

U.S. Patent Application Publication 2003/0127362 describes mercaptan reversion during hydrotreatment of FCC naphtha fractions.

SUMMARY

In various aspects, compositions are provided that can optionally be derived from the total effluent from FCC processing of a high saturates, low heteroatom content feed.

In an aspect, a naphtha boiling range composition is provided. The composition includes a T90 distillation point of 221° C. or less, an aromatics content of 10 wt % or more, a ratio of paraffins to aromatics of 1.4 or more, a sulfur content of 30 wppm or less, and/or a ratio of mercaptan sulfur to total sulfur of 0.10 to 0.90. Optionally, the composition can further include a ratio of isoparaffins to aromatics of 1.3 or more, a total aromatics content of 23 wt % or less, and/or a hydrogen content of 13.3 wt % or more. Optionally, the composition can further include a research octane number (RON) of 85 or more and/or a (RON+MON)/2 value of 85 or more.

In another aspect, a distillate boiling range composition is provided. The composition can include a T10 distillation point of 180° C. or more, a T90 distillation point of 370° C. or less, an aromatics content of 40 wt % or more, a sulfur content of between 10 to 1000 wppm, and/or a weight ratio of aliphatic sulfur to total sulfur of at least 0.15. Optionally, the composition can further include a paraffins content of 17 wt % or more, a weight ratio of paraffins to total saturates of 0.7 or more, a BMCI of 50 or more, and/or a ratio of BMCI to total sulfur of 0.05 or more. Optionally, the composition can further include 50 wt % to 80 wt % aromatics, a specific energy of 42.0 MJ/kg or higher, and/or a cetane rating of 25 or more (or 38 or more).

In still another aspect, a 340° C.+ bottoms composition is provided. The composition can include a T10 distillation point of 340° C. or more, a T90 distillation point of 550° C. or less, a sulfur content of 2500 wppm or less, a weight ratio of aliphatic sulfur to total sulfur of 0.15 or more, a saturates content of 20 wt % or more, and/or an aromatics content of 40 wt % or more. Optionally, the composition can further include a BMCI of 40 or more, a total saturates content of 25 wt % or more, a nitrogen content of 1000 wppm or less, and/or a No Flow Point of 20° C. or less.

In yet another aspect, a total effluent from an FCC process is provided. The total effluent can include a combined weight of a naphtha boiling range portion and a distillate boiling range portion of 65 wt % or more, 10 wt % or more of $C_4$ hydrocarbons, and/or a ratio of $C_3$ olefins to total $C_3$ hydrocarbons of 0.84 or more. Optionally, the total effluent can further include 12 wt % or less of 340° C.+ bottoms, 60 wt % or more of the naphtha boiling range portion, 1.5 wt % or less of $H_2$, $C_1$ hydrocarbons, and $C_2$ hydrocarbons, and/or a combined weight of the naphtha boiling range portion and the distillate boiling range portion of 72 wt % or more.

In some additional aspects, a method for performing fluid catalytic cracking on a feed including a high saturates, low heteroatom content portion is also provided.

BRIEF DESCRIPTION OF THE DRAWINGS

To assist those of ordinary skill in the relevant art in making and using the subject matter hereof, reference is made to the appended drawings, wherein:

FIG. 5 shows compositional information for various crude oils.

FIG. 6 shows compositional information for various crude oils.

FIG. 12 shows compositional features and/or properties for various FCC distillate products.

FIG. 13 shows compositional features and/or properties for various FCC 343° C.+ bottoms products.

FIG. 14 shows additional compositional features and/or properties for various FCC 343° C.+ bottoms products.

FIG. 15 shows No Flow Point versus catalyst to oil ratio for various FCC 343° C.+ bottoms products.

FIG. 16 shows conversion and yield information for FCC processing of various feeds.

DETAILED DESCRIPTION

Figure 1:
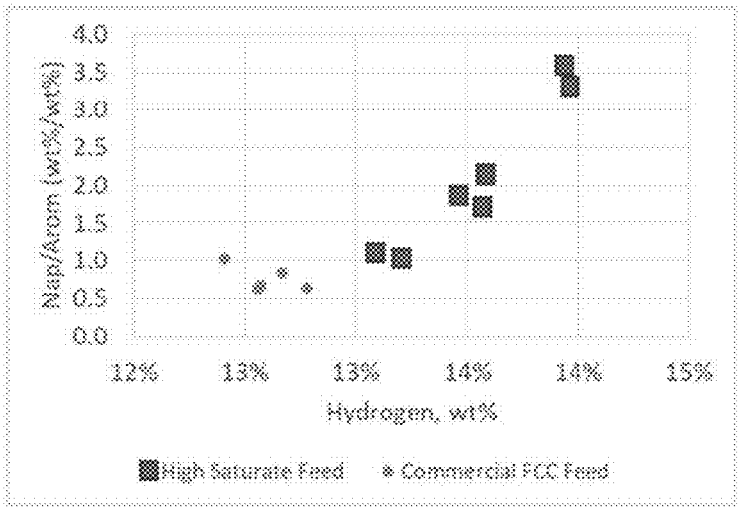
FIG. 1 shows naphthene to aromatics ratios versus hydrogen contents for various potential FCC feed fractions.

In various aspects, compositions based on effluents and/or products from FCC processing of a high saturate content, low heteroatom content feedstock are provided. Optionally, the high saturate, low heteroatom content feedstock can correspond to a feed that has not been previously hydrotreated. Optionally, the high saturates content, low heteroatom content feedstock can have an elevated ratio of naphthenes to aromatics, while still having a low but substantial content of aromatics. Optionally, the high saturates content, low heteroatom content feedstock can correspond to at least a portion of a combined feed that includes one or more other co-feeds.

By processing a high saturate content, low heteroatom content feed under various types of FCC conditions, a variety of compositions with unexpected compositional features and/or unexpected properties can be formed. In some aspects, a naphtha boiling range product fraction can be formed with an unexpected composition relative to the octane rating of the naphtha boiling range product fraction. Additionally or alternately, in some aspects, an FCC bottoms fraction can be formed with an unexpected composition and/or set of properties for a bottoms fraction. Further additionally or alternately, in some aspects, a light cycle oil (and/or a distillate boiling range cycle oil) can be formed with an unexpected set of properties. Still further additionally or alternately, in some aspects an FCC effluent can be formed with an unexpected combination of low content of light ends, an increased percentage of olefins relative to the amount of light ends, low content of bottoms, and/or improved properties for at least one of a naphtha boiling range portion, a light cycle oil boiling range portion, or a bottoms portion of the FCC effluent.

Performing FCC processing on a feed including a high saturates content, low heteroatom content feed can result in an FCC effluent having one or more unexpected compositional features and/or properties. To better illustrate such features, at least some of the compositional features and/or properties of such an effluent are described herein in relation to a naphtha boiling range portion ($C_5$-221° C.) of the FCC effluent, a distillate or light cycle oil boiling range portion (221° C.-343° C.) of the FCC effluent, or a 343° C.+ bottoms portion of the FCC effluent.

In this discussion, when describing processing of a high saturates content, low heteroatom content feed or fraction, such a feed or fraction may be referred to as a "high saturates/low heteroatom content feed" or a "high saturates/ low heteroatom content fraction". This can apply whether the high saturates, low heteroatom content feed or fraction corresponds to a vacuum gas oil boiling range feed/fraction, an atmospheric resid feed/fraction, or another type of feed that includes a vacuum gas oil boiling range portion and/or an atmospheric resid boiling range portion.

Definitions

All numerical values within the detailed description and the claims herein are modified by "about" or "approximately" the indicated value, and take into account experimental error and variations that would be expected by a person having ordinary skill in the art.

In this discussion, a shale crude oil is defined as a petroleum product with a final boiling point greater than 550° C., or greater than 600° C., that is extracted from a shale petroleum source. A shale oil fraction is defined as a boiling range fraction derived from a shale crude oil.

Unless otherwise specified, distillation points and boiling points can be determined according to ASTM D2887. For samples that are outside the scope of ASTM D2887, D7169 can be used (for higher boiling samples) or D86 can be used (for lower boiling samples). It is noted that still other methods of boiling point characterization may be provided in the examples. The values generated by such other methods are believed to be indicative of the values that would be obtained under ASTM D2887 and/or D7169 and/or D86.

In this discussion, the naphtha boiling range is defined as roughly 30° C. to 221° C. It is noted that the boiling point of $C_5$ paraffins is roughly 30° C., so the naphtha boiling range can alternatively be referred to as $C_5$-221° C. A naphtha boiling range fraction is defined as a fraction having a T10 distillation point of 30° C. or more and a T90 distillation point of 221° C. or less. The distillate boiling range and/or the light cycle oil boiling range is defined as 180° C. to 370° C. A distillate boiling range fraction is defined as a fraction having a T10 distillation point of 180° C. or more, and a T90 distillation point of 370° C. or less. In this discussion, the FCC bottoms boiling range is defined as 340° C.+. The vacuum gas oil boiling range is defined as 340° C. to 566° C. A vacuum gas oil boiling range fraction can have a T10 distillation point of 340° C. or higher and a T90 distillation point of 566° C. or less. An FCC bottoms fraction can have a T10 distillation point of 340° C. or more. An FCC bottoms fraction can have a T90 distillation point of 625° C. or less, or 600° C. or less, or 566° C. or less, or 550° C. or less, or 525° C. or less. An atmospheric resid can correspond to a fraction having a T10 distillation point of 343° C. or higher. For a general atmospheric resid, the T90 distillation point could be relatively high, such as 650° C. or possibly higher. However, for atmospheric resids derived from some shale oil fractions having a high ratio of naphthenes to aromatics, such an atmospheric resid can have a T90 distillation point of 600° C. or less. It is noted that the definitions for naphtha boiling range fraction, distillate boiling range fraction, vacuum gas oil boiling range, and FCC bottoms boiling range are based on boiling point only. Thus, a distillate boiling range fraction, naphtha boiling range fraction, vacuum gas oil boiling range fraction, or FCC bottoms boiling range fraction can include components that did not pass through a distillation tower or other separation stage based on boiling point. A shale oil vacuum gas oil boiling range fraction is defined as a shale oil fraction corresponding to the vacuum gas oil boiling range. Similarly, a shale oil atmospheric resid is defined as a shale oil fraction corresponding to the atmospheric resid boiling range.

In this discussion, unless otherwise specified, the total liquid product from FCC processing is defined as the portion of an FCC effluent that is in the liquid phase at 25° C. and 100 kPa-a. This substantially corresponds to the naphtha boiling range, distillate boiling range, and 343° C.+ bottoms portions of the effluent from an FCC process. Thus, any coke formed during FCC processing is not part of the total liquid product, and any $C_{4-}$ products (light ends) formed during FCC processing are not part of the total liquid product. The total effluent is defined as all products from FCC processing other than coke. The total product from FCC processing is the total effluent plus any coke produced during processing.

In some aspects, a feed, product, and/or other fraction can correspond to a feed, product, and/or other fraction that has not been hydroprocessed. In this discussion, a non-hydroprocessed fraction is defined as a fraction that has not been exposed to more than 10 psia (more than ~70 kPa-a) of hydrogen in the presence of a catalyst comprising a Group VI metal, a Group VIII metal, a catalyst comprising a zeolitic framework, or a combination thereof.

In this discussion, a hydroprocessed feed, product, and/or fraction refers to a hydrocarbon and/or hydrocarbonaceous (i.e., substantially composed of hydrocarbons, but including some compounds containing heteroatoms) feed, product, and/or fraction that has been exposed to a catalyst having hydroprocessing activity in the presence of 300 kPa-a or more of hydrogen at a temperature of 200° C. or more. A hydroprocessed fraction can optionally be hydroprocessed prior to separation of the fraction from a crude oil or another wider boiling range fraction.

With regard to determining paraffin, naphthene, and aromatics contents in fractions boiling above the naphtha boiling range, unless otherwise noted, supercritical fluid chromatography (SFC) was used. The characterization was performed using a commercial supercritical fluid chromatograph system, and the methodology represents an expansion on the methodology described in ASTM D5186 to allow for separate characterization of paraffins and naphthenes. The expansion on the ASTM D5186 methodology was enabled by using additional separation columns, to allow for resolution of naphthenes and paraffins. The system was equipped with the following components: a high pressure pump for delivery of supercritical carbon dioxide mobile phase; temperature controlled column oven; auto-sampler with high pressure liquid injection valve for delivery of sample material into mobile phase; flame ionization detector; mobile phase splitter (low dead volume tee); back pressure regulator to keep the $CO_2$ in supercritical state; and a computer and data system for control of components and recording of data signal. For analysis, approximately 75 milligrams of sample was diluted in 2 milliliters of toluene and loaded in standard septum cap autosampler vials. The sample was introduced based via the high pressure sampling valve. The SFC separation was performed using multiple commercial silica packed columns (5 micron with either 60 or 30 angstrom pores) connected in series (250 mm in length either 2 mm or 4 mm ID). Column temperature was held typically at 35 or 40° C. For analysis, the head pressure of columns was typically 250 bar. Liquid $CO_2$ flow rates were typically 0.3 ml/minute for 2 mm ID columns or 2.0 ml/minute for 4 mm ID columns. The SFC FID signal was integrated into paraffin and naphthenic regions. In addition to characterizing aromatics according to ASTM D5186, a supercritical fluid chromatograph was used to analyze samples for split of total paraffins and total naphthenes. A variety of standards employing typical molecular types can be used to calibrate the paraffin/naphthene split for quantification.

It is noted that the above SFC method can be used as an alternative method for characterizing aromatics in naphtha fractions. However, unless otherwise specified, aromatics contents in naphtha fractions described herein are based on ASTM D5134.

In this discussion, the term "heteroatom" is defined relative to the term "hydrocarbon". A hydrocarbon corresponds to a compound that contains only carbon and hydrogen atoms. A heteroatom is an atom in a hydrocarbon-like compound that is different from carbon and hydrogen. For example, the oxygen atom in methanol is a heteroatom. Heteroatoms that can be commonly found in hydrocarbonaceous fractions include, but are not limited to, oxygen, sulfur, and nitrogen.

In this discussion, the term "paraffin" refers to a saturated hydrocarbon chain. Thus, a paraffin is an alkane that does not include a ring structure. The paraffin may be straight-chain or branched-chain and is considered to be a non-ring compound. "Paraffin" is intended to embrace all structural isomeric forms of paraffins.

In this discussion, the term "isoparaffin" is defined to include any aliphatic paraffins that is considered to be a non-ring compound and that is not a straight chain or "n-paraffin". Thus, all types of non-ring compound branched paraffins fall within the definition of an isoparaffin.

In this discussion, the term "naphthene" refers to a cycloalkane (also known as a cycloparaffin). The term naphthene encompasses single-ring naphthenes and multi-ring naphthenes. The multi-ring naphthenes may have two or more rings, e.g., two-rings, three-rings, four-rings, five-rings, six-rings, seven-rings, eight-rings, nine-rings, and ten-rings. The rings may be fused and/or bridged. The naphthene can also include various side chains, such as one or more alkyl side chains of 1-10 carbons.

In this discussion, the term "saturates" refers to all straight chain, branched, and cyclic paraffins. Thus, saturates correspond to a combination of paraffins and naphthenes.

In this discussion, the term "aromatic ring" means five or six atoms joined in a ring structure wherein (i) at least four of the atoms joined in the ring structure are carbon atoms and (ii) all of the carbon atoms joined in the ring structure are aromatic carbon atoms. Aromatic rings having atoms attached to the ring (e.g., one or more heteroatoms, one or more carbon atoms, etc.) but which are not part of the ring structure are within the scope of the term "aromatic ring." Additionally, it is noted that ring structures that include one or more heteroatoms (such as sulfur, nitrogen, or oxygen) can correspond to an "aromatic ring" if the ring structure otherwise falls within the definition of an "aromatic ring".

In this discussion, the term "non-aromatic ring" means four or more carbon atoms joined in at least one ring structure wherein at least one of the four or more carbon atoms in the ring structure is not an aromatic carbon atom. Aromatic carbon atoms can be identified using, e.g., $^{13}C$ Nuclear magnetic resonance, for example. Non-aromatic rings having atoms attached to the ring (e.g., one or more heteroatoms, one or more carbon atoms, etc.), but which are not part of the ring structure, are within the scope of the term "non-aromatic ring."

In this discussion, the term "aromatics" refers to all compounds that include at least one aromatic ring. Such compounds that include at least one aromatic ring include compounds that have one or more hydrocarbon substituents. It is noted that a compound including at least one aromatic ring and at least one non-aromatic ring falls within the definition of the term "aromatics".

It is noted that that some hydrocarbons present within a feed or product may fall outside of the definitions for paraffins, naphthenes, and aromatics. For example, any alkenes that are not part of an aromatic compound would fall outside of the above definitions. Similarly, non-aromatic compounds that include a heteroatom, such as sulfur, oxygen, or nitrogen, are not included in the definition of paraffins or naphthenes.

With regard to characterizing properties of naphtha boiling range fractions and/or blends of such fractions with other components to form naphtha boiling range fuels, a variety of methods can be used. Density of a blend at 15° C. (kg/m$^3$) can be determined according to ASTM D4052. Sulfur (in wppm or wt %) can be determined according to ASTM D2622. Smoke point can be determined according to ASTM D1322. Research octane number (RON) can be determined according to ASTM D2699, while motor octane number (MON) can be determined according to ASTM D2700. Blending octane number can be determined by making blends of a naphtha sample with a known reference fluid (such as toluene or isooctane) and calculating the octane increase as a function of increasing concentration by using D2699 and/or D2700 to determine the RON and MON (respectively) of the blends. Aromatics, naphthenes, and paraffins can be determined using ASTM D5134. Olefins can be characterized via conventional methods using nuclear magnetic resonance (NMR) spectroscopy.

With regard to characterizing properties of distillate/light cycle oil boiling range fractions, a variety of methods can be used. Density of a blend at 15° C. (kg/m$^3$) can be determined according ASTM D4052. Sulfur (in wppm or wt %) can be determined according to ASTM D2622, while nitrogen (in wppm or wt %) can be determined according to D4629. Pour point can be determined according to ASTM D5950. Cloud point can be determined according to D2500. Freeze point can be determined according to ASTM D5972. Cetane index can be determined according to ASTM D4737, procedure A. Cetane number can be determined according to ASTM D613. Derived cetane number can be determined according to ASTM D6890. Kinematic viscosity at 40° C. (in cSt) can be determined according to ASTM D445. Flash point can be determined according to ASTM D93. Cold filter plugging point can be determined according to ASTM D6371.

With regard to characterizing properties of vacuum gas oil fractions, atmospheric resid fractions, and/or FCC bottoms fractions, a variety of methods can be used. Density of a blend at 15° C. (kg/m$^3$) can be determined according ASTM D4052. Sulfur (in wppm or wt %) can be determined according to ASTM D2622, while nitrogen (in wppm or wt %) can be determined according to D4629. Kinematic viscosity at 50° C., 70° C., and/or 100° C. can be determined according to ASTM D445. It is noted that some values in this discussion were calculated according to ASTM D341 after determination of two other kinematic viscosities according to ASTM D445. Pour point can be determined according to ASTM D5950. Cloud point can be determined according to D2500. Micro Carbon Residue (MCR) content can be determined according to ASTM D4530. The content of n-heptane insolubles can be determined according to ASTM D3279. BMCI (Bureau of Mines Correlation Index) and CCAI (Calculated Carbon Aromaticity Index) are calculated values that can be derived from other measured quantities. Flash point can be determined according to ASTM D93. The metals content can be determined according to ASTM D8056. Nitrogen can be determined according to D4629 for lower concentrations and D5762 for higher concentrations, as appropriate. It is noted that for fractions corresponding to resid or bottoms fractions, in some aspects the amounts of aromatics and saturates were characterized using a high pressure liquid chromatography (HPLC) technique described in U.S. Pat. No. 8,114,678, which is incorporated herein by reference for the limited purpose of describing determination of aromatics and saturates contents of resid or bottoms fractions.

High Saturates Content, Low Heteroatom Content Feedstocks

In various aspects, at least a portion of a feed for FCC processing can correspond to a vacuum gas oil boiling range fraction having high saturates content and low heteroatom content (i.e., a high saturates/low heteroatom content fraction). For some types of whole crudes or partial crudes, such as some shale oils, the portion of the crude boiling at 566° C. or higher can correspond to a relatively small portion of the 343° C.+ components in the whole or partial crude. In such aspects, rather than performing a vacuum distillation to form a vacuum gas oil, an atmospheric resid can be used instead as an FCC feed component (or as substantially all of the FCC feed).

In some aspects, a feedstock for FCC processing can be substantially composed of a high saturates content, low heteroatom content vacuum gas oil boiling range fraction, such as having a feedstock where 5 wt % or less of the feedstock is outside of the definition for a vacuum gas oil boiling range fraction. In other aspects, a high saturates content, low heteroatom content vacuum gas oil boiling range fraction can correspond to a portion of an atmospheric resid. In such aspects, the T90 of the atmospheric resid may be higher than 566° C., but the amount of 566° C.+ material can still be low enough for effective processing in an FCC reaction system. In still other aspects, a high saturates content, low heteroatom content vacuum gas oil boiling range fraction can correspond to a portion of a feedstock that further includes distillate and/or naphtha boiling range components. For example, in some aspects a whole shale crude oil, such as a shale crude oil, can include a high saturates content, low heteroatom content vacuum gas oil boiling range fraction while also having a sufficiently low content of components boiling above the vacuum gas oil boiling range that the whole crude could be used as an input for FCC processing. Additionally or alternately, an atmospheric resid from such a shale crude oil can be used as a feed or feed component.

In some aspects, a high saturates/low heteroatom content fraction can have a paraffin content of 25 wt % to 40 wt %; a weight ratio of naphthenes to aromatics of 1.0 to 6.0, or 1.0 to 4.0; and/or an aromatics content of 8.0 wt % to 32 wt % aromatics, or 8.0 wt % to 22 wt %, or 10 wt % to 32 wt %, or 10 wt % to 22 wt %. Additionally or alternately, the high saturates/low heteroatom content fraction can have a hydrogen content of 13.0 wt % or more, or 13.2 wt % or more, or 13.5 wt % or more, or 13.8 wt % or more, such as up to 14.5 wt % or possibly still higher. Further additionally or alternately, a high saturates/low heteroatom content fraction can have a heteroatom content (and/or a combined sulfur content and nitrogen content) of 250 wppm to 2100 wppm; a sulfur content of 100 wppm to 2000 wppm, or 100 wppm to 1000 wppm, or 300 wppm to 2000 wppm, or 300 wppm to 1000 wppm; and/or a nitrogen content of 30 wppm to 1000 wppm, or 30 wppm to 300 wppm, or 100 wppm to 1000 wppm, or 100 wppm to 300 wppm.

FIGS. 1-4 show a comparison of how the properties of various high saturates content/low heteroatom content feeds differ relative to various conventional FCC feeds. As an initial note, the high saturates/low heteroatom content feeds shown in FIGS. 1 to 4 correspond to atmospheric resids derived from a shale crude oil. Due to a low content of 566° C.+ material in the shale crude oil, the atmospheric resid was suitable as a feed to an FCC reaction system without having to perform a vacuum distillation to separate a vacuum gas oil boiling range fraction from a vacuum resid fraction.

In FIG. 1, the weight ratio of naphthenes to aromatics is plotted relative to the hydrogen content for various high saturates content/low heteroatom content fractions and various conventional FCC feeds. As shown in FIG. 1, conventional FCC feeds tend to have weight ratios of naphthenes to aromatics of 1.0 or less while also having hydrogen contents of 13.3 wt % or less. By contrast, the high saturates/low heteroatom content fractions shown in FIG. 1 have hydrogen contents of 13.3 wt % or more and weight ratios of naphthenes to aromatics of 1.0 or greater.

Figure 2:
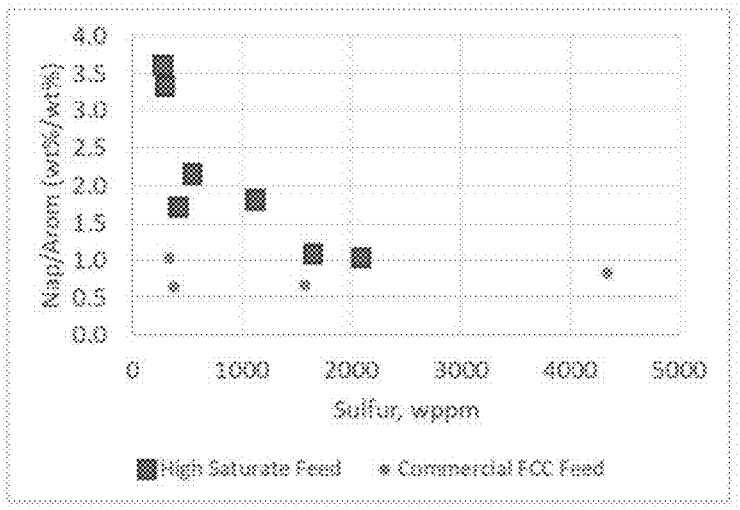
FIG. 2 shows naphthene to aromatics ratios versus sulfur contents for various potential FCC feed fractions.
Figure 3:
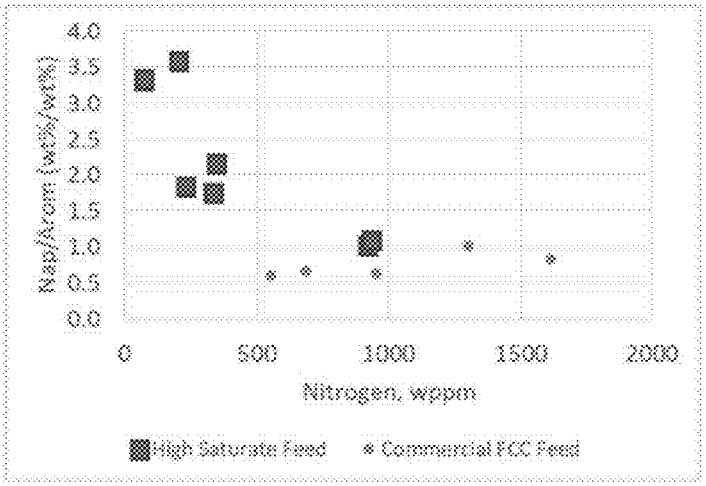
FIG. 3 shows naphthene to aromatics ratios versus nitrogen contents for various potential FCC feed fractions.

FIG. 2 shows a comparison of the weight ratio of naphthenes to aromatics versus sulfur content for the feeds/fractions shown in FIG. 1. As shown in FIG. 2, some of the conventional FCC feeds have sulfur contents of less than 1000 wppm. These conventional FCC feeds correspond to hydrotreated feeds. However, these hydrotreated feeds have weight ratios of naphthenes to aromatics of 1.0 or less. Thus, for FCC feeds based on conventional vacuum gas oil fractions, hydrotreating does not result in the elevated weight ratio of naphthenes to aromatics found in the high saturates content/low heteroatom content fractions. FIG. 3 provides a similar plot for the weight ratio of naphthenes to aromatics versus nitrogen content.

Figure 4:
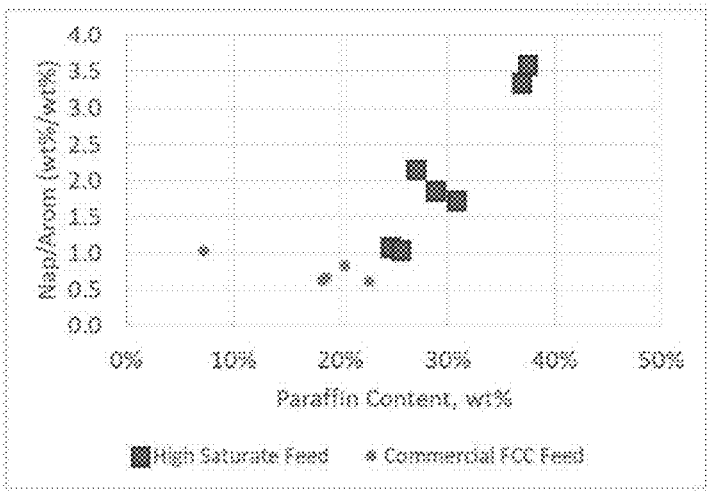
FIG. 4 shows naphthene to aromatics ratios versus paraffin contents for various potential FCC feed fractions.

FIG. 4 shows the weight ratio of naphthenes to aromatics versus paraffin content for the feeds/fractions shown in FIG. 1. As shown in FIG. 4, the conventional FCC feeds have paraffin contents of less than 25 wt %, while the high saturates content, low heteroatom content fractions have paraffin contents of 25 wt % or higher.

Table 1 provides a comparison of additional properties for non-hydrotreated virgin vacuum gas oil fractions versus properties for a high saturates content, low heteroatom content fraction (corresponding to an atmospheric resid, but mostly composed of a vacuum gas oil boiling range fraction, as shown by the distillation data in Table 1). In Table 1, the first column represents measured values for an example of a non-hydrotreated virgin vacuum gas oil that conventionally could be used as an FCC feed. The second column represents a modeled values based on an average of various representative (non-hydrotreated, roughly vacuum gas oil boiling range) FCC feeds. The third column corresponds to measured values for a high saturates content/low heteroatom content fraction.

TABLE 1

Comparison of Potential FCC Feeds

| | Straight Run FCC Feed (Measured) | Average Straight Run FCC Feed (Modeled) | High Saturate, Low Heteroatom (Measured) |
|---|---|---|---|
| Density, g/cc | 0.901 | 0.919 | 0.866 |
| Sulfur, wppm | 6750 | 7440 | 391 |

TABLE 1-continued

| Comparison of Potential FCC Feeds | | | |
|---|---|---|---|
| | Straight Run FCC Feed (Measured) | Average Straight Run FCC Feed (Modeled) | High Saturate, Low Heteroatom (Measured) |
| Nitrogen, wppm | 1480 | 1024 | 212 |
| Hydrogen Content, wt % | 12.52 | 12.51 | 13.61 |
| MCRT, wt % | 0.46 | 0.50 | 0.17 |
| SIMDIS, degF | | | |
| T10 | 602 | — | 684 |
| T30 | 745 | — | 754 |
| T50 | 816 | — | 830 |
| T70 | 892 | — | 924 |
| T90 | 1008 | — | 1083 |
| HDHA PNA | | | |
| Total Aromatics, wt % | 36 | 44 | 18 |
| Total Paraffins, wt % | 27 | 20 | 33 |
| Total Naphthenes, wt % | 35 | 35 | 50 |
| Total Saturates, wt % | 62 | 55 | 83 |
| Total Cyclics, wt % | 71 | 79 | 68 |
| Naphthenes/aromatics (wt/wt) | 1 | 0.8 | 3 |
| Paraffins/aromatics (wt/wt) | 0.8 | 0.5 | 2 |
| Saturates/aromatics (wt/wt) | 2 | 1 | 5 |

As shown in Table 1, in addition to have a higher weight ratio of naphthenes to aromatics, the high saturates/low heteroatom content fraction also has a higher weight ratio of paraffins to aromatics (1.0 or more, or 1.5 or more, or 2.0 or more, such as up to 4 or possibly still higher); a higher weight ratio of saturates to aromatics (3.0 or more, or 3.5 or more, or 4.0 or more, such as up to 10 or possibly still higher); and/or a lower density at 15° C. of 0.85 g/cm$^3$ to 0.90 g/cm$^3$, or 0.85 g/cm$^3$ to 0.89 g/cm$^3$. The order of magnitude difference in sulfur content and nitrogen content between the conventional feeds and the high saturates/low heteroatom content fraction is also notable.

In the various examples below where measured values are provided, unless otherwise specified, results for processing of a conventional FCC feed correspond to results generated by processing of the feed shown in Column 1 of Table 1. In the various examples below where measured values are provided, unless otherwise specified, results for processing of a high saturates content/low heteroatom content feed or fraction correspond to results generated by processing of the feed shown in Column 3 of Table 1.

One potential source of a high saturates content/low heteroatom content fraction is from fractionation of selected shale crude oils. FIGS. 5 and 6 show examples of the unexpected combinations of properties for shale crude oils that have a high weight ratio and/or volume ratio of naphthenes to aromatics. In FIG. 5, both the weight ratio and the volume ratio of naphthenes to aromatics is shown for five shale crude oils relative to the weight/volume percentage of paraffins in the shale crude oil. The top plot in FIG. 5 shows the weight ratio of naphthenes to aromatics, while the bottom plot shows the volume ratio. A plurality of other representative conventional crudes are also shown in FIG. 5 for comparison. As shown in FIG. 5, the selected shale crude oils have a paraffin content of greater than 40 wt % while also having a weight ratio of naphthenes to aromatics of 1.8 or more, or a corresponding volume ratio of 2.0 or more. By contrast, none of the conventional crude oils shown in FIG. 1 have a similar combination of a paraffin content of greater than 40 wt % and a weight ratio of naphthenes to aromatics of 1.8 or more, or a corresponding volume ratio of 2.0 or more.

In FIG. 6, both the volume ratio and weight ratio of naphthenes to aromatics is shown for the five shale crude oils in FIG. 6 relative to the weight of sulfur in the crude. The sulfur content of the crude in FIG. 6 is plotted on a logarithmic scale. The top plot in FIG. 6 shows the weight ratio of naphthenes to aromatics, while the bottom plot shows the volume ratio. The plurality of other representative conventional crude oils are also shown for comparison. As shown in FIG. 6, the selected shale crude oils have naphthene to aromatic volume ratios of 2.0 or more, while all of the conventional crude oils have naphthene to aromatic volume ratios below 1.8. Similarly, as shown in FIG. 6, the selected shale crude oils have naphthene to aromatic weight ratios of 1.8 or more, while all of the conventional crude oils have naphthene to aromatic weight ratios below 1.6. Additionally, the selected shale crude oils have a sulfur content of roughly 0.1 wt % or less, while all of the conventional crude oils shown in FIG. 6 have a sulfur content of greater than 0.2 wt %.

Other Co-Feeds

A high saturates content, low heteroatom content fraction can optionally be combined with one or more other feedstocks to form a feed for FCC processing, such as one or more other feedstocks including a vacuum gas oil boiling range fraction. In various aspects, the high saturates/low heteroatom content fraction can correspond to 25 wt % to 100 wt % of a feed for FCC processing, or 25 wt % to 95 wt %, or 25 wt % to 75 wt %, or 25 wt % to 50 wt %, or 40 wt % to 100 wt %, or 40 wt % to 95 wt %, or 40 wt % to 75 wt %, or 60 wt % to 100 wt %, or 60 wt % to 95 wt %, or 75 wt % to 100 wt %, or 75 wt % to 95 wt %.

A wide range of petroleum and chemical feedstocks can be used as a co-feed for FCC processing. Suitable feedstocks include whole and reduced petroleum crudes, cycle oils, gas oils, including vacuum gas oils and coker gas oils, light to heavy distillates including raw virgin distillates, hydrocrackates, hydrotreated oils, extracts, slack waxes, Fischer-Tropsch waxes, raffinates, and mixtures of these materials.

Suitable co-feeds for use as an FCC input feed can include, for example, feeds with an initial boiling point and/or a T5 boiling point and/or T10 boiling point of at least ~600° F. (~316° C.), or at least ~650° F. (~343° C.), or at least ~700° F. (371° C.), or at least ~750° F. (~399° C.). Additionally or alternately, the final boiling point and/or T95 boiling point and/or T90 boiling point of the feed can be ~1100° F. (~593° C.) or less, or ~1050° F. (~566° C.) or less, or ~1000° F. (~538° C.) or less, or ~950° F. (~510° C.) or less. In particular, a feed can have a T5 to T95 boiling range of ~316° C. to ~593° C., or a T5 to T95 boiling range of ~343° C. to ~566° C., or a T10 to T90 boiling range of ~343° C. to ~566° C. Optionally, it can be possible to use a feed that includes a lower boiling range portion. Such a feed can have an initial boiling point and/or a T5 boiling point and/or T10 boiling point of at least ~350° F. (~177° C.), or at least ~400° F. (~204° C.), or at least ~450° F. (~232° C.). In particular, such a feed can have a T5 to T95 boiling range of ~177° C. to ~593° C., or a T5 to T95 boiling range of ~232° C. to ~566° C., or a T10 to T90 boiling range of ~177° C. to ~566° C. Optionally, the feed can have a T50 distillation point of 400° C. or higher, or 425° C. or higher, such as up to 550° C. or possibly still higher.

Additionally or alternately, in some aspects at least a portion of a co-feed to an FCC reactor can correspond to a bio-derived fraction. Bio-derived fractions are derived from biomass, and therefore the carbon in a bio-derived fraction can correspond to carbon that was originally extracted from the air during growth of the biomass. As a result, any $CO_2$ generated from the biomass is offset by the $CO_2$ that was consumed during biomass growth.

For use as a co-feed to an FCC reaction system, in some aspects a bio-derived fraction can correspond to a biomass oil. Biomass oils can be formed in various ways. Some biomass oils can correspond to pyrolysis oils, such as $C_{5+}$ fractions formed by fast pyrolysis, hydrothermal liquefaction, catalytic pyrolysis, or another convenient conversion process that results in formation of at least light gases, biomass oil, and optionally a char or coke product.

Other biomass oils can correspond to residual fractions generated during biomass processing, such as oils generated as a by-product during biomass fermentation. Corn oil formed during conversion of corn biomass into ethanol is an example of an additional or residual oil formed during biomass processing. In still other aspects, a bio-derived fraction can more generally correspond to a fraction that is a liquid at 20° C. and 100 kPa-a. General examples of bio-derived fractions can include, but are not limited to, pyrolysis oils, fatty acid alkyl esters (such as fatty acid methyl esters), triglycerides, and free fatty acids.

Still other examples of potential co-feeds can include co-feeds include waste plastic and/or other types of polymers. In such aspects, pre-processing can be used to physically convert the plastic/polymers into a form suitable for introduction into an FCC reactor.

In some aspects, a co-feed for forming an FCC input feed can have a sulfur content of ~500 wppm to ~50000 wppm or more, or ~500 wppm to ~20000 wppm, or ~500 wppm to ~10000 wppm. Additionally or alternately, the nitrogen content of such a co-feed can be ~20 wppm to ~8000 wppm, or ~50 wppm to ~4000 wppm. In some aspects, a co-feed for forming an FCC input feed can correspond to a "sweet" feed, so that the sulfur content of the feed can be ~10 wppm to ~500 wppm and/or the nitrogen content can be ~1 wppm to ~100 wppm.

In some aspects, prior to FCC processing, a portion of a co-feed can be hydrotreated. An example of a suitable type of hydrotreatment can be hydrotreatment under trickle bed conditions. Hydrotreatment can be used, optionally in conjunction with other hydroprocessing, to form an input feed for FCC processing based on an initial feed.

Hydroprocessing (such as hydrotreating) can be carried out in the presence of hydrogen. A hydrogen stream can be fed or injected into a vessel or reaction zone or hydroprocessing zone corresponding to the location of a hydroprocessing catalyst. Hydrogen, contained in a hydrogen "treat gas," can be provided to the reaction zone. Treat gas, as referred to herein, can be either pure hydrogen or a hydrogen-containing gas stream containing hydrogen in an amount that for the intended reaction(s). Treat gas can optionally include one or more other gasses (e.g., nitrogen and light hydrocarbons such as methane) that do not adversely interfere with or affect either the reactions or the products. Impurities, such as $H_2S$ and $NH_3$ are undesirable and can typically be removed from the treat gas before conducting the treat gas to the reactor. In aspects where the treat gas stream can differ from a stream that substantially consists of hydrogen (i.e., at least 99 vol % hydrogen), the treat gas stream introduced into a reaction stage can contain at least 50 vol %, or at least 75 vol % hydrogen, or at least 90 vol % hydrogen.

During hydrotreatment, a feedstock can be contacted with a hydrotreating catalyst under effective hydrotreating conditions which include temperatures in the range of 450° F. to 800° F. (~232° C. to ~427° C.), or 550° F. to 750° F. (~288° C. to ~399° C.); pressures in the range of 1.5 MPag to 20.8 MPag (~200 to ~3000 psig), or 2.9 MPag to 13.9 MPag (~400 to ~2000 psig); a liquid hourly space velocity (LHSV) of from 0.1 to 10 $hr^{-1}$, or 0.1 to 5 $hr^{-1}$; and a hydrogen treat gas rate of from 430 to 2600 $Nm^3/m^3$ (~2500 to ~15000 SCF/bbl), or 850 to 1700 $Nm^3/m^3$ (~5000 to ~10000 SCF/bbl).

In an aspect, the hydrotreating step may comprise at least one hydrotreating reactor, and optionally may comprise two or more hydrotreating reactors arranged in series flow. A vapor separation drum can optionally be included after each hydrotreating reactor to remove vapor phase products from the reactor effluent(s). The vapor phase products can include hydrogen, $H_2S$, $NH_3$, and hydrocarbons containing four (4) or less carbon atoms (i.e., "$C_4$− hydrocarbons"). Optionally, a portion of the $C_3$ and/or $C_4$ products can be cooled to form liquid products. The effective hydrotreating conditions can be suitable for removal of at least about 70 wt %, or at least about 80 wt %, or at least about 90 wt % of the sulfur content in the feedstream from the resulting liquid products. Additionally or alternately, at least about 50 wt %, or at least about 75 wt % of the nitrogen content in the feedstream can be removed from the resulting liquid products. In some aspects, the final liquid product from the hydrotreating unit can contain less than about 1000 wppm sulfur, or less than about 500 wppm sulfur, or less than about 300 wppm sulfur, or less than about 100 wppm sulfur.

The effective hydrotreating conditions can optionally be suitable for incorporation of a substantial amount of additional hydrogen into the hydrotreated effluent. During hydrotreatment, the consumption of hydrogen by the feed in order to form the hydrotreated effluent can correspond to at least 500 SCF/bbl (~85 $Nm^3/m^3$) of hydrogen, or at least 1000 SCF/bbl (~170 $Nm^3/m^3$), or at least 2000 SCF/bbl (~330 $Nm^3/m^3$), or at least 2200 SCF/bbl (~370 $Nm^3/m^3$), such as up to 5000 SCF/bbl (~850 $Nm^3/m^3$) or more.

Hydrotreating catalysts suitable for use herein can include those containing at least one Group VIA metal and at least one Group VIII metal, including mixtures thereof. Examples of suitable metals include Ni, W, Mo, Co and mixtures thereof, for example CoMo, NiMoW, NiMo, or NiW. These metals or mixtures of metals are typically present as oxides or sulfides on refractory metal oxide supports. The amount of metals for supported hydrotreating catalysts, either individually or in mixtures, can range from ~0.5 to ~35 wt %, based on the weight of the catalyst. Additionally or alternately, for mixtures of Group VIA and Group VIII metals, the Group VIII metals can be present in amounts of from ~0.5 to ~5 wt % based on catalyst, and the Group VIA metals can be present in amounts of from 5 to 30 wt % based on the catalyst. A mixture of metals may also be present as a bulk metal catalyst wherein the amount of metal can comprise ~30 wt % or greater, based on catalyst weight. Suitable metal oxide supports for the hydrotreating catalysts include oxides such as silica, alumina, silica-alumina, titania, or zirconia. Examples of aluminas suitable for use as a support can include porous aluminas such as gamma or eta.

FCC Processing Conditions

An example of a suitable reactor for performing an FCC process can be a riser reactor. Within the reactor riser, a feed can be contacted with a cracking catalyst under cracking conditions thereby resulting in spent catalyst particles containing carbon deposited thereon and a lower boiling product stream. The cracking conditions can include: temperatures from 900° F. to 1060° F. (~482° C. to ~571° C.), or 950° F. to 1040° F. (~510° C. to ~560° C.); hydrocarbon partial pressures from 10 to 50 psia (~70-350 kPa-a), or from 20 to 40 psia (~140-280 kPa-a); and a catalyst to feed (wt/wt) ratio from 3.0 to 12, where the catalyst weight can correspond to total weight of the catalyst composite. Steam may be concurrently introduced with the feed into the reaction zone. The steam may comprise up to 5 wt % of the feed. In some aspects, the FCC feed residence time in the reaction zone can be less than 5 seconds, or from 3 to 5 seconds, or from 2 to 3 seconds.

Catalysts suitable for use within the FCC reactor can be fluid cracking catalysts comprising either a large-pore molecular sieve or a mixture of at least one large-pore molecular sieve catalyst and at least one medium-pore molecular sieve catalyst. Large-pore molecular sieves suitable for use herein can be any molecular sieve catalyst having an average pore diameter greater than ~0.7 nm which are typically used to catalytically "crack" hydrocarbon feeds. In various aspects, both the large-pore molecular sieves and the medium-pore molecular sieves used herein can be selected from those molecular sieves having a crystalline tetrahedral framework oxide component. For example, the crystalline tetrahedral framework oxide component can be selected from the group consisting of zeolites, tectosilicates, tetrahedral aluminophosphates (ALPOs) and tetrahedral silicoaluminophosphates (SAPOs). Preferably, the crystalline framework oxide component of both the large-pore and medium-pore catalyst can be a zeolite. More generally, a molecular sieve can correspond to a crystalline structure having a framework type recognized by the International Zeolite Association. It should be noted that when the cracking catalyst comprises a mixture of at least one large-pore molecular sieve catalyst and at least one medium-pore molecular sieve, the large-pore component can typically be used to catalyze the breakdown of primary products from the catalytic cracking reaction into clean products such as naphtha and distillates for fuels and olefins for chemical feedstocks.

Large pore molecular sieves that are typically used in commercial FCC process units can be suitable for use herein. FCC units used commercially generally employ conventional cracking catalysts which include large-pore zeolites such as USY or REY. Additional large pore molecular sieves that can be employed in accordance with the present disclosure include both natural and synthetic large pore zeolites. Non-limiting examples of natural large-pore zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Non-limiting examples of synthetic large pore zeolites are zeolites X, Y, A, L. ZK-4, ZK-5, B, E, F, H, J, M, Q, T, W, Z, alpha and beta, omega, REY and USY zeolites. In some aspects, the large pore molecular sieves used herein can be selected from large pore zeolites. In such aspects, suitable large-pore zeolites for use herein can be the faujasites, particularly zeolite Y, USY, and REY.

Medium-pore size molecular sieves that are suitable for use can include both medium pore zeolites and silicoaluminophosphates (SAPOs). Medium pore zeolites suitable for use in the practice of the present disclosure are described in "Atlas of Zeolite Structure Types", eds. W. H. Meier and D. H. Olson, Butterworth-Heineman, Third Edition, 1992, hereby incorporated by reference. The medium-pore size zeolites generally have an average pore diameter less than about 0.7 nm, typically from about 0.5 to about 0.7 nm and includes for example, MFI, MFS, MEL, MTW, EUO, MTT, HEU, FER, and TON structure type zeolites (IUPAC Commission of Zeolite Nomenclature). Non-limiting examples of such medium-pore size zeolites, include ZSM-5, ZSM-12, ZSM-22, ZSM-23, ZSM-34, ZSM-35, ZSM-38, ZSM-48, ZSM-50, silicalite, and silicalite 2. An example of a suitable medium pore zeolite can be ZSM-5, described (for example) in U.S. Pat. Nos. 3,702,886 and 3,770,614. Other suitable zeolites can include ZSM-11, described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. As mentioned above SAPOs, such as SAPO-11, SAPO-34, SAPO-41, and SAPO-42, described (for example) in U.S. Pat. No. 4,440,871 can also be used herein. Non-limiting examples of other medium pore molecular sieves that can be used herein include chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651 and iron aluminosilicates. All of the above patents are incorporated herein by reference.

The medium-pore size zeolites (or other molecular sieves) used herein can include "crystalline admixtures" which are thought to be the result of faults occurring within the crystal or crystalline area during the synthesis of the zeolites. Examples of crystalline admixtures of ZSM-5 and ZSM-11 can be found in U.S. Pat. No. 4,229,424, incorporated herein by reference. The crystalline admixtures are themselves medium-pore size zeolites, in contrast to physical admixtures of zeolites in which distinct crystals of crystallites of different zeolites are physically present in the same catalyst composite or hydrothermal reaction mixtures.

In some aspects, the large-pore zeolite catalysts and/or the medium-pore zeolite catalysts can be present as "self-bound" catalysts, where the catalyst does not include a separate binder. In some aspects, the large-pore and medium-pore catalysts can be present in an inorganic oxide matrix component that binds the catalyst components together so that the catalyst product can be hard enough to survive inter-particle and reactor wall collisions. The inorganic oxide matrix can be made from an inorganic oxide sol or gel which can be dried to "glue" the catalyst components together. Preferably, the inorganic oxide matrix can be comprised of oxides of silicon and aluminum. It can be preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ε-alumina, κ-alumina, and ρ-alumina can be employed. Preferably, the alumina species can be an aluminum trihydroxide such as gibbsite, bayerite, nordstrandite, or doyelite. Additionally or alternately, the matrix material may contain phosphorous or aluminum phosphate. Optionally, the large-pore catalysts and medium-pore catalysts be present in the same or different catalyst particles, in the aforesaid inorganic oxide matrix.

In the FCC reactor, the cracked FCC product can be removed from the fluidized catalyst particles. Preferably this can be done with mechanical separation devices, such as an FCC cyclone. The FCC product can be removed from the reactor via an overhead line, cooled and sent to a fractionator tower for separation into various cracked hydrocarbon product streams. These product streams may include, but are not limited to, a light gas stream (generally comprising $C_4$ and lighter hydrocarbon materials), a naphtha (gasoline) stream, a distillate (diesel and/or light cycle oil) stream, and other various heavier gas oil product streams. The other heavier stream or streams can include a bottoms stream.

In the FCC reactor, after removing most of the cracked FCC product through mechanical means, the majority of, and preferably substantially all of, the spent catalyst particles can be conducted to a stripping zone within the FCC reactor. The stripping zone can typically contain a dense bed (or "dense phase") of catalyst particles where stripping of volatiles takes place by use of a stripping agent such as steam. There can also be space above the stripping zone with a substantially lower catalyst density which space can be referred to as a "dilute phase". This dilute phase can be thought of as either a dilute phase of the reactor or stripper in that it will typically be at the bottom of the reactor leading to the stripper.

In some aspects, the majority of, and preferably substantially all of, the stripped catalyst particles are subsequently conducted to a regeneration zone wherein the spent catalyst particles are regenerated by burning coke from the spent catalyst particles in the presence of an oxygen containing gas, preferably air thus producing regenerated catalyst particles. This regeneration step restores catalyst activity and simultaneously heats the catalyst to a temperature from 1200° F. to 1400° F. (~649 to 760° C.). The majority of, and preferably substantially all of the hot regenerated catalyst particles can then be recycled to the FCC reaction zone where they contact injected FCC feed.

In this discussion, reference may be made to performing FCC processing at low severity or high severity. A variety of options are available for modifying the severity of an FCC process, including modifying the temperature, pressure, residence time, catalyst, and/or the catalyst to oil (i.e., catalyst to feed) ratio. In this discussion, unless otherwise specified, references to low severity processing or high severity processing are references to changes in the riser overhead temperature and catalyst to oil ratio. For low severity processing, such processing can roughly correspond to, for example, processing at a riser overhead temperature of 932° F.-960° F. (500° C.-516° C.) and a catalyst to oil (i.e., catalyst to feed) ratio of 4.0-5.5. For high severity processing, such processing can roughly correspond to, for example, processing at a riser overhead temperature of 1040° F.-1060° F. (560° C.-571° C.) and a catalyst to oil ratio of 9.0-10.5. It is noted that a rough average of current typical FCC processing conditions can correspond to a riser overhead temperature of 965° F.-985° F. (518° C.-529° C.) and a catalyst to oil ratio of 6.0-7.5. It is noted that other combinations of temperature, pressure, residence time, and/or catalyst to oil ratio could similarly be used to generate low severity processing conditions, high severity processing conditions, or processing conditions comparable to industry average conditions.

Life Cycle Assessment and Carbon Intensity

Life cycle assessment (LCA) is a method of quantifying the "comprehensive" environmental impacts of manufactured products, including fuel products, from "cradle to grave". Environmental impacts may include greenhouse gas (GHG) emissions, freshwater impacts, or other impacts on the environment associated with the finished product. The general guidelines for LCA are specified in ISO 14040.

The "carbon intensity" of a fuel product (e.g. gasoline) is defined as the life cycle GHG emissions associated with that product (kg $CO_2$ eq) relative to the energy content of that fuel product (MJ, LHV basis). Life cycle GHG emissions associated with fuel products must include GHG emissions associated with crude oil production; crude oil transportation to a refinery; refining of the crude oil; transportation of the refined product to point of "fill"; and combustion of the fuel product.

GHG emissions associated with the stages of refined product life cycles are assessed as follows.

(1) GHG emissions associated with drilling and well completion—including hydraulic fracturing, shall be normalized with respect to the expected ultimate recovery of sales-quality crude oil from the well.

(2) All GHG emissions associated with the production of oil and associated gas, including those associated with (a) operation of artificial lift devices, (b) separation of oil, gas, and water, (c) crude oil stabilization and/or upgrading, among other GHG emissions sources shall be normalized with respect to the volume of oil transferred to sales (e.g. to crude oil pipelines or rail). The fractions of GHG emissions associated with production equipment to be allocated to crude oil, natural gas, and other hydrocarbon products (e.g. natural gas liquids) shall be specified accordance with ISO 14040.

(3) GHG emissions associated with rail, pipeline or other forms of transportation between the production site(s) to the refinery shall be normalized with respect to the volume of crude oil transferred to the refinery.

(4) GHG emissions associated with the refining of crude oil to make liquefied petroleum gas, gasoline, distillate fuels and other products shall be assessed, explicitly accounting for the material flows within the refinery. These emissions shall be normalized with respect to the volume of crude oil refined.

(5) All of the preceding GHG emissions shall be summed to obtain the "Well to refinery" (WTR) GHG intensity of crude oil (e.g. kg $CO_2$ eq/bbl crude).

(6) For each refined product, the WTR GHG emissions shall be divided by the product yield (barrels of refined product/barrels of crude), and then multiplied by the share of refinery GHG specific to that refined product. The allocation procedure shall be conducted in accordance with ISO 14040. This procedure yields the WTR GHG intensity of each refined product (e.g., kg $CO_2$ eq/bbl gasoline, or kg $CO_2$ eq/bbl distillate fuel, or $CO_2$ eq/bbl residual fuel).

(7) GHG emissions associated with rail, pipeline or other forms of transportation between the refinery and point of fueling shall be normalized with respect to the volume of each refined product sold. The sum of the GHG emissions associated with this step and the previous step of this procedure is denoted the "Well to tank" (WTT) GHG intensity of the refined product.

(8) GHG emissions associated with the combustion of refined products shall be assessed and normalized with respect to the volume of each refined product sold.

(9) The "carbon intensity" of each refined product is the sum of the combustion emissions (kg $CO_2$ eq/bbl) and the "WTT" emissions (kg $CO_2$ eq/bbl) relative to the energy value of the refined product during combustion. Following the convention of the EPA Renewable Fuel Standard 2, these emissions are expressed in terms of the lower heating value (LHV) of the fuel, i.e. g $CO_2$ eq/MJ refined product (LHV basis).

In the above methodology, the dominant contribution for the amount of $CO_2$ produced per MJ of refined product is the $CO_2$ formed during combustion of the product. Because the $CO_2$ generated during combustion is such a high percentage of the total carbon intensity, achieving even small or incremental reductions in carbon intensity has traditionally been challenging.

In this discussion, a low carbon intensity fuel or fuel blending product corresponds to a fuel or fuel blending product that has reduced GHG emissions per unit of lower of heating value relative to a fuel or fuel blending product derived from a conventional petroleum source. In some aspects, the reduced GHG emissions can be due in part to reduced refinery processing. For example, fractions that are not hydroprocessed for sulfur removal have reduced well-to-refinery emissions relative to fractions that require hydroprocessing prior to incorporation into a fuel. In various aspects, an unexpectedly high weight ratio of naphthenes to aromatics in a shale oil fraction can indicate a fraction with reduced GHG emissions, and therefore a lower carbon intensity.

Yet other ways of reducing carbon intensity for a hydrocarbon fraction can be related to methods used for extraction of a crude oil. For example, carbon intensity for a fraction can be reduced by using solar power, hydroelectric power, or another renewable energy source as the power source for equipment involved in the extraction process, either during drilling and well completion and/or during production of crude oil. As another example, extracting crude oil from an extraction site without using artificial lift can reduce the carbon intensity associated with a fuel.

In various aspects, it has been discovered that high saturates, low heteroatom content feeds can be used to form FCC product fractions with reduced carbon intensities. Based on a variety of compositional features, FCC product fractions derived from high saturates, low heteroatom content feeds can be used as fuels and/or fuel blending components with a reduced or minimized amount of additional processing. For example, the sulfur content of such FCC product fractions can be low enough to use in a variety of fuel and/or fuel blending applications without having to subsequently expose the FCC product fractions to hydroprocessing. Additionally, in aspects where the high saturates, low heteroatom content feeds are derived from some sources, such as selected shale crude oils, the feed itself can have a reduced carbon intensity due to reduced or minimized requirements for extraction of the feed from a production site. FCC GHG emissions are reduced because the coke yield produced from the high saturates, low heteroatom content feed is very low, allowing for alternative lower carbon intensity fuels such as natural gas to make-up the heat duty required to fuel the reaction.

Examples

FCC processing at different severities was used to generate FCC effluents based on a conventional feed and a high saturates/low heteroatom content feed. In Examples 1-3, the properties of the naphtha boiling range portions (Example 1), distillate boiling range portions (Example 2), and 343° C.+ bottoms portions (Example 3) are described. Example 4 provides additional description related to the total effluent as well as olefins in the light ends of the total effluent. Example 5 is related to potential uses of FCC 343° C.+ bottoms derived from a high saturates/low heteroatom content feed as a blend component in various type of marine fuels.

For all of the experimental examples, the data was generated in a pilot scale unit (Davison Circulating Riser) using a commercially available FCC catalyst.

EXAMPLES

Example 1—Naphtha FCC Products

In various aspects, the naphtha boiling range portion of an effluent from FCC processing of a feed including a high saturates content/low heteroatom content fraction can have one or more unexpected compositional features and/or properties. Some of the unexpected compositional features and/or properties can be related to the octane number of the naphtha boiling range portion relative to the composition of the naphtha boiling range portion.

Generally, a naphtha boiling range product from FCC processing of a high saturates/low heteroatom content feed can have one or more of the following features and/or properties: an octane number (RON+MON/2) of 80 or more, or 82 or more, or 83 or more, such as up to 90 or possibly still higher; a sulfur content of 50 wppm or less, or 30 wppm or less, such as down to 1.0 wppm or possibly still lower; and/or a weight ratio of mercaptan sulfur (and/or aliphatic sulfur) to total sulfur of between 0.10 to 0.90, or 0.10 to 0.80, or 0.10 to 0.50, or 0.15 to 0.90, or 0.15 to 0.80, or 0.15 to 0.50. Additionally or alternately, the naphtha boiling range product can have a RON of 85 or more, or 87 or more, or 89 or more, such as up to 100 or possibly still higher.

Additionally or alternately, a naphtha boiling range product from FCC processing of a high saturates/low heteroatom content feed can have one or more of the following features and/or properties: a paraffins content of 18 wt % or more, or 20 wt % or more, or 22 wt % or more, such as up to 35 wt % or possibly still higher; an isoparaffins content of 18 wt % or more, or 20 wt % or more, or 22 wt % or more, such as up to 35 wt % or possibly still higher; an aromatics content of 26 wt % or less, or 25 wt % or less, or 24 wt % or less, such as down to 10 wt % or possibly still lower; a weight ratio of paraffins to aromatics (and/or isoparaffins to aromatics) of 0.9 or higher, or 1.0 or higher, or 1.1 or higher, such as up to 1.4 or possibly still higher; and/or a weight ratio of naphthenes to aromatics of 0.5 or higher, or 0.55 or higher, or 0.6 or higher, such as up to 1.0 or possibly still higher. It is noted that an aromatics content of 10 wt % or more will typically be present, due in part to the nature of FCC processing conditions.

One option for characterizing the octane number for a composition is to use an average of the research octane number (RON) and the motor octane number (MON). This can be expressed mathematically as (RON+MON)/2. In some aspects, the naphtha boiling range portion of the FCC effluent from processing of a high saturates/low heteroatom content fraction can have a (RON+MON)/2 value that is similar to the value for the naphtha fraction from FCC processing of a conventional feed. However, the composition of the naphtha boiling range portion of the FCC effluent from processing a high saturates/low heteroatom content fraction can be substantially different from a conventional FCC naphtha fraction.

Figure 7:
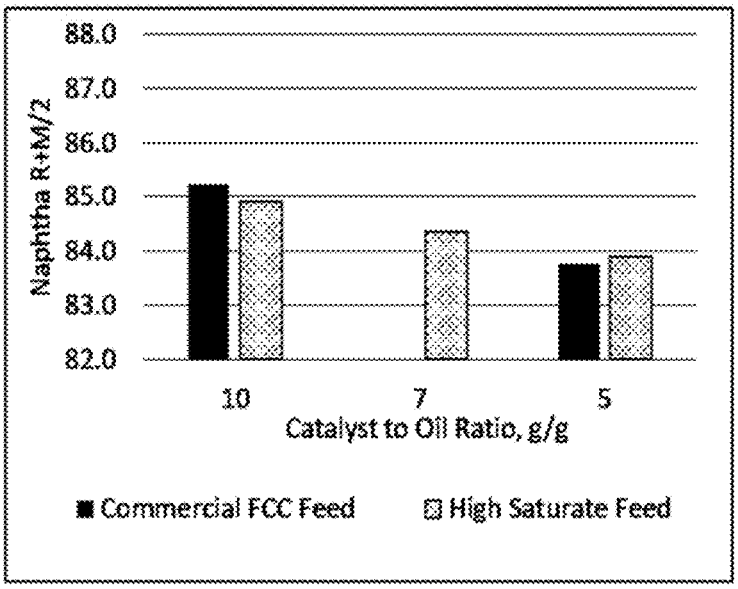
FIG. 7 shows octane number versus catalyst to oil ratio for various FCC naphtha products.

FIG. 7 shows (RON+MON)/2 values from processing of the conventional feed (left bars) and the high saturates/low heteroatom content feed (right bars) from Table 1. As shown in FIG. 7, the resulting (RON+MON)/2 values for processing under both high severity conditions (catalyst to oil ratio of ~10.5) and low severity conditions (catalyst to oil ratio ~5) are within one octane number of each other. An intermediate severity (catalyst to oil ratio ~7) is also presented for the high saturates/low heteroatom content feed. It is noted that in Example 1, all processing was performed at a temperature of 980° F. (527° C.), so that the difference between high severity and low severity processing corresponded to the difference in the catalyst to oil ratio.

Figure 8:
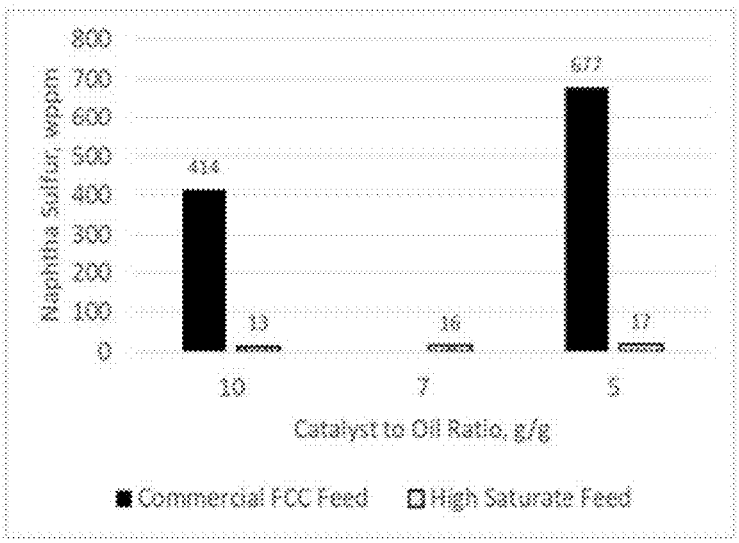
FIG. 8 shows sulfur versus catalyst to oil ratio for various FCC naphtha products.

Although the octane numbers for the two FCC naphtha products are similar, there are substantial compositional differences. One difference is in the amount of sulfur present in the FCC naphtha products. FIG. 8 shows sulfur content for the naphtha products from FCC processing of the conventional feed (left bars) and the high saturates/low heteroatom content feed (right bars) at low severity and high severity processing conditions. Again, an intermediate severity is shown only for the high saturates/low heteroatom content feed. As shown in FIG. 8, the sulfur content of the naphtha product from processing of the high saturates/low heteroatom content feed is more than an order of magnitude lower than the conventional FCC naphtha product. This can provide an advantage as the naphtha product from FCC processing of the high saturates/low heteroatom content feed can potentially be added to a gasoline pool without further processing for sulfur removal. By contrast, the conventional FCC naphtha requires additional processing for sulfur removal prior to incorporation into a gasoline pool.

Figure 9:
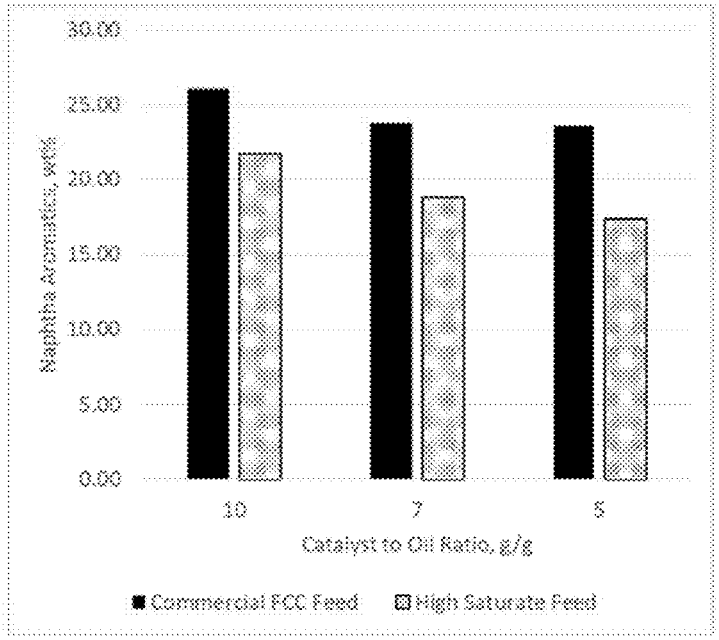
FIG. 9 shows aromatics versus catalyst to oil ratio for various FCC naphtha products.
Figure 10:
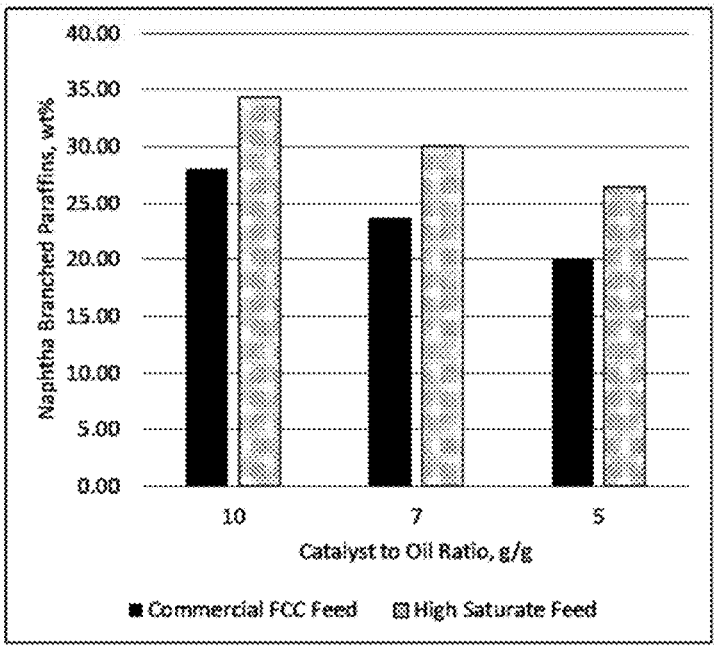
FIG. 10 shows isoparaffins versus catalyst to oil ratio for various FCC naphtha products.

Additional compositional differences are shown in FIG. 9 and FIG. 10. FIG. 9 shows the aromatics content of the resulting FCC naphtha fractions from high, medium, and low severity FCC processing. As shown in FIG. 9, the aromatics content of the conventional FCC naphtha fractions (left bars) is higher at all processing conditions than the aromatics content of the FCC naphtha fractions from processing of the high saturates/low heteroatom content feed (right bars and the intermediate severity bar). In fact, even when comparing the low severity conventional FCC naphtha with the high severity naphtha derived from the high saturates/low heteroatom content feed, the aromatics content of the conventional naphtha is still higher. This demonstrates that the octane number of the naphtha product from FCC processing of the high saturates/low heteroatom content fraction is based on a different compositional profile relative to a conventional FCC naphtha product.

FIG. 10 further illustrates this compositional difference. FIG. 10 shows the weight percentage of isoparaffins from FCC processing at the various severities. As shown in FIG. 10, the naphtha product from FCC processing of the high saturates/low heteroatom content feed includes a higher weight percent of isoparaffins at all processing severities. This higher isoparaffin content represents at least part of the compositional difference for how the naphtha product from processing of the high saturates/low heteroatom content feed can maintain a comparable octane number while having a reduced aromatics content relative to a conventional naphtha product.

Table 2 provides further details regarding the differences in composition for the FCC naphtha products from processing of the feeds from Table 1 under high severity and low severity conditions. In Table 2, the left two data columns correspond to high severity processing, while the right two data columns correspond to low severity processing. It is noted that the naphtha products in Table 2 from processing of the high saturates/low heteroatom content feed have a T90 distillation point of 221° C. or less, or 210° C. or less, or 200° C. or less.

TABLE 2

FCC Naphtha Product Properties

| Feed Description | Commercial FCC Feed | High Saturate Feed | Commercial FCC Feed | High Saturate Feed |
|---|---|---|---|---|
| RTT, degF | 980 | 980 | 980 | 980 |
| C/O, g/g | 10.7 | 10.3 | 5.1 | 4.9 |
| Naphtha (C5-430° F.) | | | | |
| Density, g/cc | 0.746 | 0.732 | 0.761 | 0.740 |
| Total Sulfur, wppm | 414 | 13 | 677 | 17 |
| Mecaptan Sulfur, wppm | 16 | — | 21 | 3 |
| Mercaptan Sulfur to Total Sulfur Ratio, wt/wt | 0.04 | — | 0.03 | 0.18 |
| HDT Total Sulfur, wppm | 20 | — | 20 | — |
| HDT Mercaptan Sulfur to Total Sulfur Ratio, wt/wt | 1.0 | — | 1.0 | — |
| Nitrogen, wppm | 27 | 1 | 34 | 2 |
| Hydrogen, wt % | 13.23 | 13.37 | 13.03 | 13.54 |
| D2887 SIMDIS, wt % (° F.) | | | | |
| 5 | 73 | 66 | 97 | 78 |
| 10 | 104 | 94 | 128 | 106 |
| 50 | 241 | 215 | 276 | 240 |
| 90 | 376 | 371 | 408 | 377 |
| 95 | 408 | 402 | 429 | 408 |
| ASTM D5134, wt % | | | | |
| Isoparaffins | 28.0 | 34.3 | 20.1 | 26.5 |
| Linear Paraffins | 3.7 | 3.9 | 3.2 | 3.5 |
| Total Paraffins | 31.7 | 38.3 | 23.3 | 29.9 |
| Aromatics | 26.0 | 21.6 | 23.6 | 17.4 |
| Naphthenes | 12.0 | 11.7 | 13.6 | 13.2 |
| Olefins | 30.2 | 28.4 | 39.6 | 39.5 |
| Naphthenes/Aromatics (wt/wt) | 0.46 | 0.54 | 0.58 | 0.76 |
| Paraffins/Aromatics (wt/wt) | 1.22 | 1.77 | 0.99 | 1.72 |
| Gums in Fuels, mg/100 mL | | | | |
| C7 Washed Residue | 11.0 | 10.5 | 15.0 | <0.5 |
| UnWashed Residue | 13.5 | 12.0 | 16.5 | 1.0 |
| Oxidative Stability, Time to Pressure Drop, min | 35 | 14 | 28 | 10 |
| RON | 90.4 | 90.0 | 89.8 | 89.8 |
| MON | 80.0 | 79.8 | 77.7 | 78.0 |
| (RON + MON)/2 | 85.2 | 84.9 | 83.8 | 83.9 |
| HDT RON | 79.6 | — | 76.6 | — |
| HDT MON | 78.8 | — | 73.3 | — |
| HDT (RON + MON)/2 | 79.2 | — | 75.0 | — |

As shown in Table 2, there are a number of differences between the conventional FCC naphtha products and the FCC naphtha products from processing of the high saturates/low heteroatom content feed. The conventional FCC products have hydrogen contents of less than 13.3 wt %, while the products of the high saturates/low heteroatom feed have hydrogen contents of 13.3 wt % or higher. For aromatics as determined according to ASTM D5134, the conventional FCC products have aromatics contents of greater than 23 wt %, while the products of the high saturates/low heteroatom feed have aromatics contents of 23 wt % or less, or 22 wt % or less, or 20 wt % or less, such as down to 10 wt % or possibly still lower. The conventional FCC products have a weight ratio of paraffins to aromatics of less than 1.3, while the products of the high saturates/low heteroatom feed have a weight ratio of paraffins to aromatics of 1.4 or higher, or 1.5 or higher, or 1.7 or higher, such as up to 2.5 or possibly still higher. Similarly, the conventional FCC products have a weight ratio of paraffins to aromatics of less than 1.2, while the products of the high saturates/low heteroatom feed have a weight ratio of paraffins to aromatics of 1.3 or higher, or 1.4 or higher, or 1.5 or higher, such as up to 2.2 or possibly still higher. At comparable processing conditions, the conventional FCC products have a lower weight ratio of naphthenes to aromatics than the FCC naphtha fractions derived from the high saturates/low heteroatom content feed.

As shown in Table 2, the naphtha products from FCC processing of the high saturates/low heteroatom content feed also have substantially lower sulfur contents. In addition to lower total sulfur, the naphtha products from FCC processing of the high saturates/low heteroatom content feed also have a different type of sulfur distribution than a conventional FCC naphtha product. This can be seen, for example, in the ratio of mercaptan sulfur to total sulfur for the two different types of FCC naphtha products. In Table 2, the naphtha products from FCC processing of the high saturates/low heteroatom content feed having a weight ratio of mercaptans to total sulfur of between 0.10 and 0.90, or between 0.10 and 0.80, or between 0.10 and 0.50. By contrast, the weight ratio of mercaptans to total sulfur for the conventional FCC naphtha products is 0.05 or less. Without being bound by any particular theory, it is believed that the high saturates/low heteroatom content feed contains a higher percentage of aliphatic sulfur than a conventional feed for FCC processing, and this results in a different type of sulfur distribution in the resulting FCC naphtha product. In addition to low sulfur content, the nitrogen content of the naphtha products derived from the high saturates/low heteroatom content feed is also lower. The naphtha products derived from the high saturates/low heteroatom content feed can have a nitrogen content of 5.0 wppm or less, or 3.0 wppm or less, such as down to 0.1 wppm or possibly still lower. This is in contrast to the conventional naphtha products, which have nitrogen contents of 20 wppm or higher.

The substantially lower sulfur contents of the FCC naphtha products from processing of a high saturates/low heteroatom content feed can also reduce or minimize the need to perform additional processing on the naphtha products prior to incorporating the naphtha products into a gasoline pool. For comparison, the compositions of the conventional FCC naphtha products were used as inputs for a hydrotreating model, to determine the change in octane value that would result if the conventional FCC naphtha products were hydrotreated to a sufficient degree to have a sulfur content of 20 wppm or less. This is comparable to the sulfur levels of the FCC naphtha products from processing of the high saturates/low heteroatom content feed without any additional hydrotreatment. As shown in Table 2, modeling of using conventional hydrotreatment to reduce the sulfur contents of the conventional FCC naphtha products to 20 wppm predicted that the hydrotreated conventional FCC naphtha products would have (RON+MON)/2 values that were reduced by roughly 6.0-8.0 octane numbers. It is noted that the amount of octane loss can vary depending on the exact nature of a sulfur removal method, the values in Table 2 show that the low sulfur contents in the FCC naphtha products derived from the high saturates/low heteroatom content feed can reduce or minimize octane reduction due to further processing.

It is further noted that the mercaptan sulfur to total sulfur ratio in the hydrotreated conventional FCC products is also expected to be substantially different from the mercaptan to sulfur ratio in the FCC naphtha products from processing of the high saturates/low heteroatom content feed. One of the difficulties with hydroproces sing of FCC naphtha fractions is that FCC naphtha fractions typically contain a substantial content of olefins. For example, the olefin contents of the various FCC naphtha products in Table 2 are all greater than 20 wt %. While olefins are beneficial for octane, such olefins are also susceptible to mercaptan reversion during hydrotreatment. The mercaptan reversion process is explained in U.S. Patent Application Publication 2003/0127362. As explained in that publication, as $H_2S$ is formed during naphtha hydrotreatment, a portion of the $H_2S$ can react with olefins present in the naphtha fraction to form mercaptans. Based on the mechanisms described in U.S. Patent Application Publication 2003/0127362, when hydrotreatment is used to reduce the sulfur content of an FCC naphtha fraction from greater than roughly 250 wppm to a value of 30 wppm or less, it is believed that substantially all of the remaining sulfur in the hydrotreated naphtha will correspond to mercaptans formed by this mercaptan reversion mechanism. As a result, it is believed that hydrotreating an FCC naphtha to achieve a sulfur content of 20 wppm or less will result in a mercaptan sulfur to total sulfur weight ratio of 0.8 or higher, such as possibly up to 1.0 (i.e., all sulfur is mercaptan sulfur). This is in contrast to the FCC naphtha products from processing of the high saturates/low heteroatom content feed, where the weight ratio of mercaptan sulfur to total sulfur is between 0.10 and 0.40. Thus, the weight ratio of mercaptan sulfur to total sulfur in an FCC naphtha fraction can be used to distinguish between a hydrotreated conventional FCC naphtha fraction and a low sulfur fraction from FCC processing of a high saturates, low heteroatom content feed.

The FCC naphtha product from low severity processing of the high saturates/low heteroatom content feed also satisfies some additional requirements from ASTM D4814 that are not met by the other products shown in Table 2. For example, ASTM D4814 requires a gum content of less than 5 mg/100 mL, in the heptane washed residue. The FCC product from low severity processing of the high saturates/low heteroatom content feed has a gum content of less than 0.5 mg/100 mL in the heptane washed residue, in compliance with this standard. By the other products shown in Table 2 have gum contents of 10 mg/100 mL or higher in the heptane washed residue.

It is further noted that the FCC naphtha products from processing of the high saturates/low heteroatom content feed provide higher values of (RON/MON)/2 in comparison with the straight run naphtha from the original crude source for the feed. The high saturates/low heteroatom content feed corresponds to an atmospheric resid from a shale crude oil. The (RON+MON)/2 value for the straight run naphtha from that crude oil was roughly 75, while the (RON+MON)/2 values for the FCC naphtha products are roughly 85.

Additional characterization was performed using some other methods. For aromatics, supercritical fluid chromatography (SFC) was performed in order to characterize the types of aromatics present in the naphtha. For olefins, an alternative method of olefin determination based on NMR was used. Table 3 shows the results from these alternative methods.

TABLE 3

Additional Analysis of FCC Naphtha HDHA_SFC, wt %

| | | | | |
|---|---|---|---|---|
| 1 Ring Aromatics | 26.9 | 23.9 | 24.3 | 19.0 |
| 2 Ring Aromatics | 1.5 | 1.4 | 2.0 | 1.0 |
| 3+ Ring Aromatics | 0.2 | 0.6 | 0.5 | 0.4 |
| Total Aromatics | 28.5 | 25.9 | 26.8 | 20.3 |
| Olefins (NMR), wt % | 34.2 | 23.0 | 46.1 | 47.2 |

As shown in Table 3, the total aromatics as determined by the supercritical fluid chromatography method were slightly higher than the total aromatics determined according to ASTM D5134. However, the general nature of the distribution of aromatics can still be understood. As shown in Table 3, more than 90 wt % of the aromatics present within the FCC naphtha samples correspond to 1-ring aromatics. For the FCC naphtha derived from the high saturates/low heteroatom content feed, the content of 1-ring aromatics can be 24.0 wt % or less, or 22 wt % or less, or 20 wt % or less, such as down to 15 wt % or possibly still lower. With regard to olefins, while the absolute values are different, the trends in Table 3 are similar to the trends in Table 2. The low severity naphtha fractions in both Table 2 and Table 3 have similar olefin contents, while the high severity conventional FCC naphtha has a higher olefin content in both Table 2 and Table 3 than the naphtha from high severity processing of the high saturates/low heteroatom content feed.

Example 2—Distillate and/or Light Cycle Oil FCC Products

In various aspects, the distillate boiling range portion (alternatively referred to as light cycle oil boiling range portion) of an effluent from FCC processing of a feed including a high saturates content/low heteroatom content fraction can have one or more unexpected compositional features and/or properties. It is noted that in Example 2, all processing was performed at a temperature of 980° F. (527° C.), so that the difference between high severity and low severity processing corresponded to the difference in the catalyst to oil ratio.

Generally, a distillate boiling range product from FCC processing of a high saturates/low heteroatom content feed can have one or more of the following features and/or properties: a specific energy (MJ/kg) of 42.0 or higher, or 42.2 or higher, such as up to 44.0 or possibly still higher; a sulfur content of 1.0 wppm to 1000 wppm, or 10 wppm to 1000 wppm, or 10 wppm to 800 wppm, or 10 wppm to 500 wppm, or 50 wppm to 1000 wppm, or 50 wppm to 800 wppm, or 100 wppm to 1000 wppm, or 100 wppm to 800 wppm; a nitrogen content of 150 wppm or less, or 100 wppm or less, such as down to 1.0 wppm or possibly still lower; and/or a weight ratio of aliphatic sulfur to total sulfur of 0.15 or more, or 0.20 or more, or 0.30 or more, such as up to 0.60 or possibly still higher.

Additionally or alternately, a distillate boiling range product from FCC processing of a high saturates/low heteroatom content feed can have one or more of the following features and/or properties: a paraffins content of 17 wt % or more, or 20 wt % or more, or 22 wt % or more, such as up to 35 wt % or possibly still higher; a total saturates content of 20 wt % to 45 wt %; a weight ratio of paraffins to saturates of 0.7 or higher, such as up to 1.0 or possibly still higher; a total aromatics content of 40 wt % or more, or 45 wt % or more, or 50 wt % or more, or 55 wt % or more, or 60 wt % or more, such as up to 80 wt % or possibly still higher; and/or a BMCI value of 50 or more, or 60 or more, or 70 or more, such as up to 90 or possibly still higher.

Figure 11:
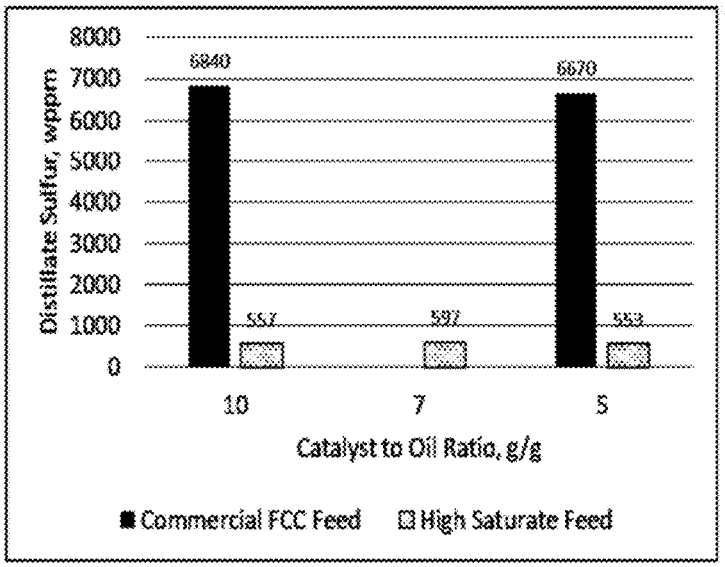
FIG. 11 shows sulfur versus catalyst to oil ratio for various FCC distillate products.

The distillate FCC products generated from the high saturates/low heteroatom content feed contain roughly an order of magnitude lower sulfur content than a conventional FCC distillate product. FIG. 11 shows a comparison of the sulfur contents of distillate products from FCC processing of the feeds shown in Table 1 under a high severity and a low severity processing condition. For the distillate product, this could enable distillate product to be used neat or blended at higher concentrations into burner fuel oils and/or marine gas oils which can have maximum sulfur specifications such as 500 wppm, 1000 wppm, or 5000 wppm sulfur.

Table 4 provides further details regarding the differences in composition for the FCC distillate products from processing of the feeds from Table 1 under high severity and low severity conditions. In Table 4, the left two data columns correspond to high severity processing, while the right two data columns correspond to low severity processing. In addition to various compositional features, Table 4 also provides BMCI values for the distillate products. It is noted that the "HDT" values for aliphatic sulfur to total sulfur and for BMCI correspond to modeled values.

TABLE 4

Compositional Features of FCC Distillate Products

| Feed Description | Commercial FCC Feed | High Saturate Feed | Commercial FCC Feed | High Saturate Feed | |
|---|---|---|---|---|---|
| RTT, degF | 980 | 980 | 980 | 980 | |
| C/O, g/g | 10.7 | 10.3 | 5.1 | 4.9 | |
| Distillate (430-650 F.) | | | | | ECA ISO8217 DMA |
| Density, g/cc | 0.917 | 0.926 | 0.895 | 0.883 | |
| Total Sulfur, wppm | 6840 | 557 | 6670 | 553 | ≤1000 |
| Aliphatic Sulfur, wppm | 290 | 230 | 340 | 190 | |
| Aliphatic Sulfur to Total Sulfur Ratio, wt/wt | 0.04 | 0.41 | 0.05 | 0.34 | |
| HDT Aliphatic Sulfur to Total Sulfur Ratio wt/wt | 0.01 | — | 0.02 | — | |
| Nitrogen, wppm | 303 | 52 | 438 | 98 | |
| Hydrogen, wt % | 10.36 | 10.07 | 11.28 | 11.55 | |
| D2887 SIMDIS, wt % (° F.) | | | | | |
| 5 | 396 | 441 | 445 | 428 | |
| 10 | 412 | 450 | 456 | 444 | |
| 50 | 510 | 512 | 546 | 524 | |

TABLE 4-continued

| Compositional Features of FCC Distillate Products | | | | |
|---|---|---|---|---|
| 90 | 606 | 605 | 633 | 654 |
| 95 | 624 | 625 | 651 | 673 |
| D2887 SIMDIS Convert to D86, wt % (° F.) | | | | |
| 10 | 471 | 502 | 511 | 496 |
| 50 | 507 | 509 | 543 | 522 |
| 90 | 570 | 570 | 595 | 615 |
| BMCI | 68.6 | 72.7 | 54.9 | 51.1 |
| BMCI to Total Sulfur Ratio | 0.01 | 0.13 | 0.01 | 0.09 |
| HDT BMCI | 50.3 | — | 43.2 | — |
| Olefins, wt % | 3.3 | None detected by NMR | 10.1 | 9.9 |
| HDHA_SFC, wt % | | | | |
| Paraffins | 17.6 | 17.3 | 19.4 | 24.6 |
| 1 Ring Naphthenes | 5.7 | 4.1 | 10.6 | 10.2 |
| 2+ Ring Naphthenes | 6.4 | 3.1 | 16.0 | 9.9 |
| 1 Ring Aromatics | 24.7 | 21.8 | 20.4 | 23.9 |
| 2 Ring Aromatics | 28.6 | 37.8 | 18.7 | 19.4 |
| 3+ Ring Aromatics | 17.1 | 16.0 | 15.0 | 12.0 |
| Total Aromatics | 70.3 | 75.6 | 54.1 | 55.3 |

As shown in Table 4, the sulfur of the FCC distillate products derived from the high saturates/low heteroatom content feed is about an order of magnitude lower than the sulfur contents of the conventional FCC distillate products, while the BMCI values are comparable. However, in order to reduce the sulfur content of the conventional FCC distillate products to a comparable level, a significant BMCI debit would be incurred. To illustrate this, modeling was performed using the conventional FCC distillate products as inputs for a model distillate hydrotreating reaction. As shown in Table 4, the level of hydrotreating necessary to reduce the sulfur contents of the conventional FCC distillate fractions to roughly 550 wppm sulfur resulted in a reduction in BMCI of 10 or greater. Such hydrotreatment can also remove substantially all aliphatic sulfur, so that the aliphatic sulfur to total sulfur ratio approaches zero. It is also noted that the sulfur content of the FCC distillate products formed from the high saturates/low heteroatom content feed is below 1000 wppm, so that the FCC distillate product derived from the high saturates/low heteroatom content feed is below the sulfur requirement for fuels in an Emission Control Area (ECA).

FIG. 12 provides additional characterization of the FCC distillate products. As shown in FIG. 12, the FCC distillate products generated from the high saturates/low heteroatom content feed have a higher specific energy content (weight basis) relative to the products generated from the commercial FCC feed. Without being bound by any particular theory, it is believed that this advantage in specific energy is due in part to the lower density, higher hydrogen content, lower BMCI, and lower heavy (3+ ring) aromatics content shown in Table 4 and FIG. 12.

Table 4 and FIG. 12 also shows that the distillate FCC product generated from the high saturates, low heteroatom content feed under lower severity process condition (C/O ~5) has higher paraffin content, higher cetane index, and lower density compared to the conventional feed under similar conditions. For the limits tested, results indicate that the FCC distillate product derived from the high saturates, low heteroatom content feed under lower severity conditions could potentially meet the requirements for an ISO 8217 DMA (marine gasoil) as a neat material whereas the other distillate FCC products could not. For example, most FCC distillate materials similar to this product would need to be further processed or upgraded to meet sulfur needs, whereas the distillate product shown in Table 4 and FIG. 12 already meets ECA sulfur level (<1000 wppm sulfur). The FCC product shown in Table 4 and FIG. 12 is also predicted to confer compatibility improvements when blended or used neat as a distillate marine fuel. It has a BMCI above 50 which is atypical of finished distillate marine fuel and on-road diesel fuels (which are typically up to ~35), and if used as a sulfur correcting blend component for residual marine fuels could have improved compatibility with asphaltenes compared to a typical distillate components used for sulfur correction with lower BMCI. Additionally or alternately, the distillate fraction can have a ratio of BMCI to total sulfur of 0.05 or more, or 0.08 or more, such as up to 0.25 or possibly still higher.

In various aspects, the distillate fraction from FCC processing of a high saturates/low heteroatom content feed can have a cetane index of 25 or more, or 30 or more, or 35 or more, or 38 or more, such as up to 50 or possibly still higher. The higher cetane index of the distillate FCC product generated from the high saturates/low heteroatom content feed under lower severity process condition may be explained by comparing the compositional differences with FCC distillate from the conventional FCC feed under similar process conditions. The two FCC products have similar aromatics content with the high saturate feed slightly higher; thus, the level of saturates (paraffins plus naphthenes) is similar for the two, and slightly lower for product from the high saturates/low heteroatom content feed. Saturates in a distillate material contribute positively to cetane, with the general trend that cetane is highest for n-paraffins, followed by iso-paraffins, naphthenes, aromatics, and finally polyaromatics at the bottom (where "paraffins" would be n- plus iso-paraffins and "saturates" would be n- plus iso-paraffins plus naphthenes). Directionally, the FCC distillate derived from the high saturates/low heteroatom content feed has a higher paraffin content and lower naphthene content. This corresponds to a higher proportion of paraffins relative to the total saturates, at a similar aromatics content.

The FCC distillate product derived from the high saturates/low heteroatom content feed at high severity FCC operation (C/O ratio=~10.5) has a lower Cloud Point, Pour Point, and Cold Filter Plugging Point (CFPP) relative to the conventional distillate product. The advantaged cold flow properties can be utilized when blending the distillate product with other paraffinic fuels (such as the straight run high saturate feed distillate) to meet heating oil and/or marine fuel cold flow property specifications.

Example 3—FCC Bottoms Products

In various aspects, the bottoms (343° C.+) portion of an effluent from FCC processing of a feed including a high saturates content/low heteroatom content fraction can have one or more unexpected compositional features and/or properties. It is noted that in Example 3, all processing was performed at a temperature of 980° F. (527° C.), so that the difference between high severity and low severity processing corresponded to the difference in the catalyst to oil ratio.

Generally, a bottoms (343° C.+) product from FCC processing of a high saturates/low heteroatom content feed can have one or more of the following features and/or properties: a sulfur content of 3000 wppm or less, or 2500 wppm or less, or 2000 wppm or less, such as down to 100 wppm or possibly still lower; a nitrogen content of 1000 wppm or less, or 700 wppm or less, such as down to 10 wppm or possibly still lower; and/or a weight ratio of aliphatic sulfur to total sulfur of 0.15 or more, or 0.20 or more, or 0.30 or more, such as up to 0.70 or possibly still higher.

Additionally or alternately, a bottoms product from FCC processing of a high saturates/low heteroatom content feed can have one or more of the following features and/or properties: a No Flow Point of 20° C. or less; a total saturates content of 20 wt % or more, or 25 wt % or more, or 30 wt % or more, such as up to 50 wt % or possibly still higher; and/or an aromatics content of 40 wt % or more, or 45 wt % or more, or 50 wt % or more, such as up to 80 wt % or possibly still higher. Additionally or alternately, an FCC bottoms fraction can have an n-heptane insolubles content of 5.0 wt % or less, or 3.0 wt % or less, such as down to substantially no content of n-heptane insolubles.

In some aspects, bottoms product from FCC processing can have a T90 distillation point of 600° C. or less, or 566° C. or less, or 550° C. or less, or 525° C. or less, or 510° C. or less, or 500° C. or less. The bottoms product can have a T10 distillation point of 343° C. or higher.

In some aspects, a bottoms product from FCC processing can have a kinematic viscosity at 50° C. (KV50) of 150 cSt or less, or 100 cSt or less, or 50 cSt or less, or 25 cSt or less, such as down to 5.0 cSt or possibly still lower. Additionally or alternately, in some aspects the bottoms product can have one or more of a saturates to aromatics ratio of 0.8 or more, or 1.0 or more, such as up to 2.5 or possibly still higher; a density at 15° C. of 0.92 g/cm$^3$ or less, such as down to 0.86 g/cm$^3$; a hydrogen content of 11.5 wt % or more, or 12.0 wt % or more, such as up to 13.0 wt % or possibly still higher; a calculated carbon aromaticity index (CCAI) of 825 or less, or 810 or less, such as down to 780 or possibly still lower; and/or a net specific energy of 41.8 MJ/kg or more, or 42.0 MJ/kg or more, such as up to 43.5 MJ/kg or possibly still higher.

FIG. 13 and FIG. 14 provide further details regarding the differences in composition for the FCC bottom products from processing of the feeds from Table 1 under high severity and low severity conditions. In FIG. 13 and FIG. 14, the left two data columns correspond to high severity processing, while the right two data columns correspond to low severity processing.

As shown in FIG. 14, the FCC bottoms (343° C.+) products generated from the high saturates/low heteroatom content feed have a higher specific energy content (weight basis) relative to the products generated from the commercial FCC feed at similar severity. Without being bound by any particular theory, it is believed that this advantage in specific energy is due in part to the lower density, higher hydrogen content, lower SBN/BMCI, and lower heavy (ARC4) aromatics content shown in FIG. 13 and FIG. 14.

As shown in FIG. 13, the bottoms (343° C.+) FCC product generated from the high saturates/low heteroatom content feed contains less sulfur (about one order of magnitude) compared to the product generated from the commercial FCC feed. As a result, the bottoms product from FCC processing of the high saturates/low heteroatom content feed could be used neat as a low sulfur fuel oil (LSFO) and/or a very low sulfur fuel oil (VLSFO), or could be a primary blend component of an ECA marine fuel. It is further noted that the FCC product bottoms from processing the high saturates/low heteroatom content feed has comparable sulfur content to the straight run high saturate/low heteroatom content 343° C.+ bottoms (prior to any processing, such as FCC processing) but a substantially different ratio of naphthenes to aromatics.

As shown in FIG. 13, the FCC 343 ° C.+ bottoms product generated from the high saturates/low heteroatom content feed has a lower micro carbon residue (MCRT) and n-heptane insolubles content relative to the bottoms product derived from the commercial FCC feed. A lower MCRT and n-heptane insolubles measurement indicates that the asphaltene content is lower for the bottoms product from FCC processing of the high saturates/low heteroatom content feed. There are several potential benefits of low asphaltene content and low MCRT, including (but not limited to) reduction in the consequence of an incompatibility event during fuel oil blending (less solid precipitant), and a useful blend component to pair with high-MCRT components or correct high/off-spec blends to make an overall blend that is on-spec for MCRT.

The FCC bottoms product generated from the high saturate feed under lower severity process condition (C/O ~5) has higher saturates content, lower CCAI, and lower density compared to the conventional feed under similar conditions. Based on the values for total sulfur, kinematic viscosity at 50° C. (KV50), MCRT, CCAI, density at 15° C., and the No Flow Point (comparable to pour point), the results in FIG. 13 and FIG. 14 indicate that the bottoms product from low severity FCC processing of the high saturates/low heteroatom content feed could potentially meet ISO 8217 RME 180 (marine residual fuel oil) as a neat material. By contrast, a typical conventional FCC bottoms products could not, as illustrated by the conventional FCC bottoms products shown in FIG. 13 and FIG. 14. Instead, most FCC bottoms materials similar to this product would need to be further processed or upgraded or blended with low sulfur fluxants to meet sulfur needs. By contrast, with regard to sulfur content, the FCC bottoms products derived from the high saturates/low heteroatom content feed can meet the VLSFO sulfur level (<5000 wppm sulfur) without further processing.

FIG. 15 shows a comparison of the No Flow Points (listed in FIG. 14) for the various FCC bottoms products. As shown in FIG. 14 and in FIG. 15, for all FCC severities tested, the FCC bottoms 343 ° C.+ bottoms product derived from the high saturates/low heteroatom content feed has a lower No Flow Point (Pour Point surrogate, ASTM D7346) relative to the commercial FCC bottoms product. The fact that the cold flow properties are advantaged for the FCC bottoms product derived from the high saturates/low heteroatom feed is unexpected: The FCC bottoms product compositions in FIG. 13 indicate a higher saturate concentration in the product derived from the high saturates/low heteroatom content feed relative to the product generated from the commercial FCC feed. Higher saturates content, which includes paraffins that can form waxes, may be associated with worse cold flow properties. By contrast, it is observed for the distillate fractions in Example 2 that higher saturates content is associated with worse cold flow (e.g. cloud point) for each process condition, as would typically be expected for a fuel composition.

Example 4—Total Effluent and Light Olefins

FIG. 16 shows the overall yields from FCC processing of the feeds in Table 1, along with amount of FCC conversion relative to 221° C. As shown in FIG. 16, at comparable processing conditions, the amount of conversion relative to 221° C. for the high saturates/low heteroatom content feed is substantially higher then the conversion level for the conventional feed.

With regard to overall yields, as shown in FIG. 16, the coke yield from FCC processing of the high saturates/low heteroatom content feed, relative to the weight of the feed, is 3.5 wt % or less, or 3.2 wt % or less, or 3.0 wt % or less, such as down to 1.0 wt % or possibly still lower. It is noted that at this level of coke production, some amount of supplemental fuel in the regenerator may be required in order to maintain heat balance for FCC operation. Additionally or alternately, using a co-feed with a higher content of micro carbon residue and/or providing an external heat source could also assist with maintaining heat balance.

In addition to have a reduced or minimized yield of coke, the yield of dry gas ($H_2$, $C_1$, and $C_2$ compounds) is also reduced or minimized. As shown in FIG. 16, the yield of dry gas is 1.5 wt % or less, or 1.2 wt % or less, such as down to 0.5 wt % or possibly still lower (either relative to the weight of the feed, or relative to the weight of the total effluent). Although the yield of dry gas is reduced or minimized, the yield of $C_3$ and $C_4$ compounds is increased. This combination of a reduced yield of dry gas plus increased yield of $C_3$-$C_4$ compounds is unexpected. As shown in FIG. 16, the combined yield of $C_3$ and $C_4$ compounds derived from the high saturates/low heteroatom content feed is 14.0 wt % or more, or 15.0 wt % or more, or 17.0 wt % or more, such as up to 22 wt % or possibly still higher. This is in contrast to the conventional FCC effluent, where the $C_3$ and $C_4$ compounds correspond to less than 14.0 wt % relative to the weight of the feed. Additionally or alternately, the yield of $C_4$ compounds derived from the high saturates/low heteroatom content feed is 10.0 wt % or more, or 12.0 wt % or more, such as up to 15 wt % or possibly still higher. Further additionally or alternately, the combined yield of naphtha and distillate (LCO) from FCC processing of the high saturates/low heteroatom content feed can be 65 wt % or more relative to the weight of the total effluent and/or the weight of the feed to the FCC process, or 70 wt % or more, or 72 wt % or more, such as up to 80 wt % or possibly still higher. It is noted that in FIG. 16, the combined yield of naphtha and distillate for the conventional feeds was less than 71 wt %.

Due to the combination of low dry gas yield and high $C_3$-$C_4$ yield, the light ends product ($C_1$-$C_4$) from FCC processing of the high saturates/low heteroatom content feed can have an increased yield of $C_3$-$C_4$ olefins while avoiding an increase in low value dry gas. Additionally, the yield of gasoline is also increased. This unexpected combination of yields is not achieved when processing the conventional feed.

Figure 17:
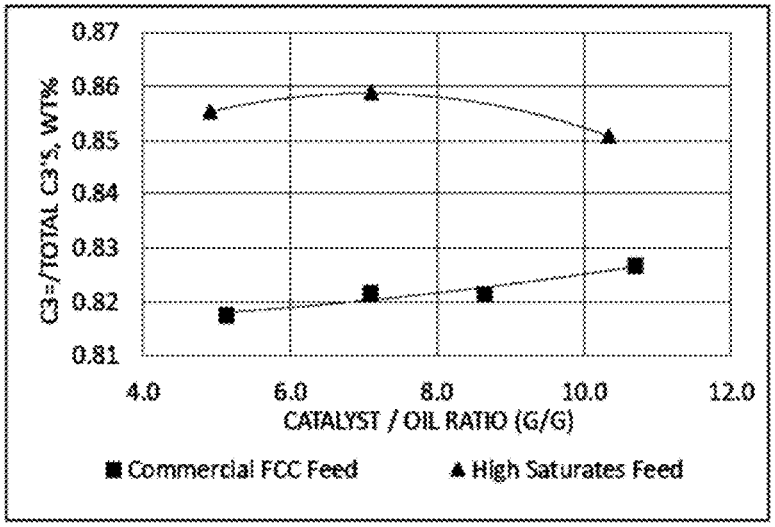
FIG. 17 shows the weight ratio of $C_3$ olefins to total $C_3$ products versus catalyst to oil ratio from FCC processing of various feeds.

Additionally or alternately, the ratio of $C_3$ olefins to total $C_3$ components is increased for the effluent from FCC processing of the high saturates/low heteroatom content feed. FIG. 17 shows the ratio of $C_3$ olefins to total $C_3$ compounds from processing of the high saturates/low heteroatom feed versus a conventional feed. As shown in FIG. 17, the weight ratio of $C_3$ olefins to total $C_3$ compounds is 0.84 or more, or 0.85 or more at all processing severities for the high saturates/low heteroatom content feed (such as up to 0.90 or possibly still higher). By contrast, for the conventional FCC feed, the ratio of $C_3$ olefins to total $C_3$ compounds is 0.83 or less.

Figure 18:
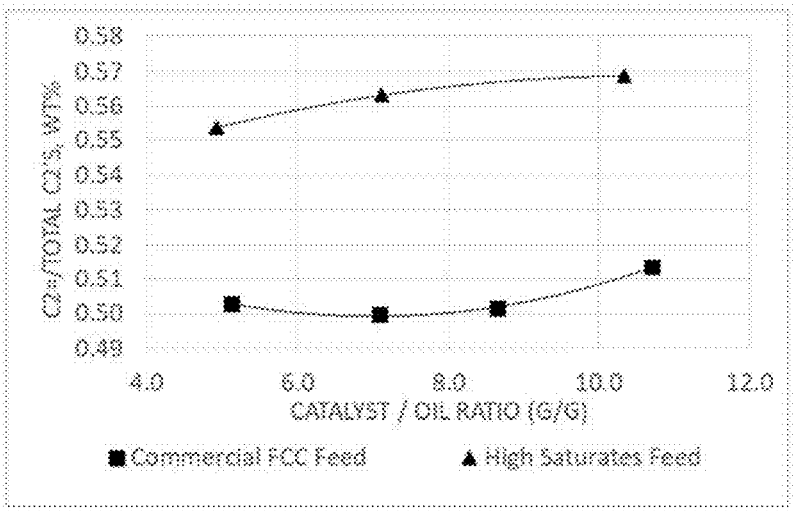
FIG. 18 shows the weight ratio of $C_2$ olefins to total $C_2$ products versus catalyst to oil ratio from FCC processing of various feeds.

Further additionally or alternately, the ratio of $C_2$ olefins to total $C_2$ components is increased for the effluent from FCC processing of the high saturates/low heteroatom content feed. FIG. 18 shows the ratio of $C_2$ olefins to total $C_2$ compounds from processing of the high saturates/low heteroatom feed versus a conventional feed. As shown in FIG. 18, the weight ratio of $C_2$ olefins to total $C_2$ compounds is 0.54 or more, or 0.55 or more at all processing severities for the high saturates/low heteroatom content feed (such as up to 0.70 or possibly still higher). By contrast, for the conventional FCC feed, the ratio of $C_3$ olefins to total $C_3$ compounds is 0.52 or less.

One of the potential advantages of the product slate from processing a high saturates/low heteroatom content feed is that olefin production can be increased while reducing or minimizing the decrease in the combined naphtha and distillate yield. As shown in FIG. 16, the increased yield of $C_3$-$C_4$ olefins is primarily based on the reduction in dry gas and coke, as opposed to representing a substantial loss in combined naphtha and distillate yield.

It is also noted that the liquid product sulfur and nitrogen content are lower for the FCC liquid products derived from the high saturates/low heteroatom content feed. The lower sulfur content can reduce or minimize the downstream hydrotreating severity required to treat the naphtha and distillate fractions. The lower sulfur and nitrogen content of the FCC naphtha fraction can make the stream a more attractive catalytic naphtha reforming feedstock for Benzene, Toluene, and Xylene (BTX) and/or hydrogen production. The bottoms stream (343° C.+) sulfur is also decreased. For a marine fuel oil incorporating such a bottoms fraction, this can reduce the high sulfur debit (IMO 2020) and possibly eliminate it entirely.

Example 5—Marine Fuel Blends

The FCC 343° C.+ bottoms fraction from low severity processing of the high saturates/low heteroatom content feed above has unexpected properties that are beneficial when blending with marine fuel blend components to form a marine fuel. Table 5 provides properties of 5 conventional gasoil components, 3 conventional resid components, and the 343° C.+ bottoms product. There components were used to make two series of fuel blends that illustrate the advantages that can be achieved by using the 343 ° C.+ bottoms derived from the high saturates/low heteroatom content feed as a marine fuel blend component. The two series of blends below illustrate how the bottoms product derived from the high saturates/low heteroatom content feed can be beneficial for blends a) that are primarily comprised of low BMCI gasoil components or b) that are primarily composed of residual fuel oil components, while still producing marine fuels that meet the properties described for an RMD 80 0.5 wt % sulfur fuel oil.

TABLE 5

Components for Marine Fuel Blending

| Fuel Components | Density (g/mL) | Viscosity 50° C. (cSt) | Sulfur (wt %) | BMCI | MCRT (wt %) | Asphaltene (wt %) |
|---|---|---|---|---|---|---|
| Gasoil Component 1 | 0.8883 | 35.49 | 0.0007 | 34.7 | 0.10 | 0 |
| Gasoil Component 2 | 0.8827 | 32.50 | 0.0008 | 31.5 | — | 0 |
| Gasoil Component 3 | 0.8499 | 4.151 | — | 29.9 | — | 0 |
| Gasoil Component 4 | 0.8514 | 2.500 | 0.0003 | 37.8 | 0.01 | 0 |
| Gasoil Component 5 | 0.8749 | 9.853 | 0.0845 | 32.4 | 0.01 | 0 |
| Resid Component 1 | 0.9766 | 410.5 | 1.3 | 62.2 | 12.60 | 2.60 |
| Resid Component 2 | 0.9820 | 638.7 | 1.67 | 63.6 | — | 5.7 |
| Resid Component 3 | 1.0058 | 486.7 | 2.45 | 79.9 | — | 14.10 |
| High Saturate Feed Low Severity | 0.9040 | 18.15 | 0.107 | 44.8 | 0.40 | 0.28 |

Table 6 shows a first series of blends base on attempting to make a RMD 80 0.5 wt % sulfur fuel oil out of a blend that primarily corresponds to a conventional gas oil. The asterisks in Table 6 represent properties that fall within the RMD 80 specification values provided in the bottom row of the table.

TABLE 6

Blends Based on Gas Oils

| Marine Fuel Blends | Density (g/mL) | Viscosity 50° C. (cSt) | Sulfur (wt %) | BMCI | MCRT (wt %) | Asphaltene (wt %) | TSP (wt %) |
|---|---|---|---|---|---|---|---|
| Fuel Blend 1: 2% Resid Component 1 and 98% Gasoil Component 1 | 0.8903 | *36.87 | *0.0292 | *35.3 | *0.37 | *0.06 | 0.06 |
| Fuel Blend 2: 1.6% Resid Component 1, 20% Gasoil Component 3 and 78.4% Gasoil Component 1 | 0.8827 | *21.02 | — | *34.2 | — | *0.05 | 0.04 |
| Fuel Blend 3: 2% Resid Component 2 and 98% Gasoil Component 2 | 0.8845 | *33.97 | *0.0378 | *32.1 | — | 0.13 | 0.07 |
| Fuel Blend 4: 8% Resid Component 2 and 92% Gasoil Component 2 | 0.8905 | *38.91 | *0.1480 | *34.1 | — | 0.50 | 0.28 |
| Fuel Blend 5: 1.9% Resid Component 1, 5% Resid Component 3, and 93.10% Gasoil Component 1 | 0.8960 | *40.76 | *0.1651 | *33.5 | — | *0.85 | 0.66 |
| Fuel Blend 6: 36% High Saturate Feed Low Severity and 64% Gasoil Component 1 | *0.8940 | *27.50 | *0.0394 | *38.3 | *0.21 | *0.10 | *0.10 |
| RMD 80 VLSFO Spec, max | 0.975 | 80 | 0.5 | — | 14 | — | 0.1 |

*Within RMD 80 specification values

In some cases it is necessary to blend a significant amount of gas oil component with a small amount of residual fuel oil component to generate an RMD 80 0.5% sulfur fuel oil. Table 6 contains marine fuel blends which have 92% or more of a gas oil component blended with one or more residual fuel oil components (Fuel Blends 1-5). Often gas oil components have low BMCI values in the low to mid 30's. In these cases the gas oil component usually has a high paraffinic content and may cause asphaltenes from residual fuel components to precipitate and cause blend incompatibility. Fuel Blends 1 and 2 detail that TSP of the final blends containing highly paraffinic gas oil components correlates roughly with the asphaltene content of blend. Blends 3 contains a similar gas oil component to Blend 1, and the asphaltene content of the final blend also tracks similarly to the final TSP value. Blend 4 consists of the same components as blend 3, but contains 4 times as much Residual Fuel Component 2 as Blend 3, and due to the increase in asphaltene content, the blend did not meet TSP for a RMD 80 0.5% sulfur fuel oil. Blend 5 also corresponded to a blend that had substantially higher asphaltene content than 0.1% and therefore had a final TSP value that could be predicted to be high due to the asphaltene content predicted for the final blend. Generally, it is beneficial when blending low -BMCI gas oil components at significant concentrations with residual fuel components to predict the final blend asphaltene content and ensure it remains at or below 0.1%. Fuel Blend 6 is different from the fuel blends because the bottoms product from low severity FCC processing of the high saturates/low heteroatom content feed inherently contains asphaltenes, but at a much lower level than the residual fuel components. This allows the bottoms product to be blended in place of a resid component at up to 36 wt % with Gasoil Component 1 and still meet a predicted asphaltene content of 0.1% which will correlate to a TSP value of 0.1% or lower. Even when blending approximately 10 times more of the bottoms product with Gasoil Component 1 (as compared with the amount of Resid Component 1 in Fuel Blend 1), there does not appear to be any detrimental impacts to the final blend properties shown to meet RMD 80 0.5% sulfur fuel oil quality.

Table 7 shows another series of blends, but with emphasis on providing a high resid content while satisfying the RMD 80 0.5 wt % sulfur fuel oil specification. The asterisks in Table 7 represent properties that fall within the RMD 80 specification values provided in the bottom row of the table.

TABLE 7

Additional Marine Fuel Oil Blends

| Marine Fuel Blends | Density (g/mL) | Viscosity 50° C. (cSt) | Sulfur (wt %) | BMCI | MCR (wt %) | Asphaltene (wt %) | TSP (wt %) |
|---|---|---|---|---|---|---|---|
| Fuel Blend 7: 31% Resid Component 1 and 69% High Saturate Feed Low Severity | *0.9265 | *38.60 | *0.4968 | *50.2 | *4.39 | *1.04 | — |
| Fuel Blend 8: 35% Resid Component 1 and 65% Gasoil Component 4 | *0.8952 | *7.484 | *0.4966 | *46.3 | *4.87 | *0.99 | — |
| Fuel Blend 9: 31% Resid Component 1 and 69% Gasoil Component 5 | *0.9064 | *22.83 | *0.4905 | *41.6 | *4.22 | *0.87 | — |
| RMD 80 VLSFO Spec, max | 0.975 | 80 | 0.5 | — | 14 | — | 0.1 |

*Within RMD 80 specification values

Another option to generate an RMD 80 0.5 wt % sulfur fuel oil is to begin with a high-sulfur resid component and blend it with a significant amount of a low-sulfur gas oil component to reduce the sulfur in the final blend to less than 0.5%. However, there can be significant consequences to blending such high concentrations of gas oil components. In the instance of Fuel blend 8, Resid Component 1 has a viscosity of 410 cSt at 50° C. but when combined with Gas oil Component 4 to meet 0.5 wt % sulfur, it has a final viscosity of only 7.484 cSt at 50 C. This is a low viscosity for an RMD 80 0.5% sulfur fuel oil and if it contained high-melt wax that needed to be melted, the blend could have an injection viscosity below OEM recommendations. Also, depending on the paraffinic quality of the gas oil used, the BMCI of the blend may be low enough affect blend TSP or further fuel blending compatibility on board vessels. Fuel Blend 9 is a good example of this concern. Resid Component 1 is blended with Gas oil Component 5, which has a viscosity of 9.853 cSt at 50° C. The final Fuel Blend 9 has less than 0.5% sulfur and a reasonable viscosity of 22.83 cSt at 50° C. which should keep the blend viscosity above OEM recommendations even if fuel injection temperature is increased to dissolve high-melt wax. However, Gas oil Component 5 is very paraffinic and Fuel 9 has a BMCI of 41.6, which is significantly lower than Resid Component 1 and could put the blend compatibility risk and may have a TSP greater than 0.1%. Fuel Blend 7 containing the FCC bottoms product derived from the high saturates/low heteroatom content feed (in place of a gas oil component) can be blended with roughly the same amount of Resid Component 1 compared to both Fuel Blends 8 and 9, and also has significantly improved viscosity and BMCI values compared to both of these blends. Fuel Blend 9 has a kinematic viscosity of 38.6 cSt which is about 520% and 170% greater than Fuel Blend 8 and Fuel Blend 9, respectively. At 38.6 cSt kinematic viscosity, Fuel Blend 7 has no concern meeting OEM viscosity recommendation at fuel injection temperatures needed to dissolve high-melt wax. Also Fuel Blend 7 with a BMCI of 50.2 is 8.4% and 20.7% higher than Fuel Blend 8 and Fuel Blend 9, respectively. The improved BMCI for Blend 7 means that it is more likely to pass TSP as an RMD 80 0.5% sulfur fuel oil and will be more compatible with asphaltene containing resid components than Fuel Blends 8 and 9.

ADDITIONAL EMBODIMENTS

Embodiment 1. A naphtha boiling range composition comprising a T90 distillation point of 221° C. or less, an aromatics content of 10 wt % or more, a ratio of paraffins to aromatics of 1.4 or more, a sulfur content of 30 wppm or less, and a ratio of mercaptan sulfur to total sulfur of 0.10 to 0.90.

Embodiment 2. The composition of Embodiment 1, wherein the composition comprises a ratio of isoparaffins to aromatics of 1.3 or more.

Embodiment 3. The composition of Embodiment 1 or Embodiment 2, wherein the composition comprises a total aromatics content of 23 wt % or less, or wherein the composition comprises a hydrogen content of 13.3 wt % or more, or a combination thereof.

Embodiment 4. The composition of any of Embodiments 1-3, wherein the composition comprises a research octane number (RON) of 85 or more.

Embodiment 5. The composition of any of Embodiments 1-4, wherein the composition comprises a research octane number (RON) of 89 or more, or wherein the composition comprises a (RON+MON)/2 value of 85 or more, or a combination thereof.

Embodiment 6. The composition of any of Embodiments 1-5, wherein the composition comprises a T90 distillation point of 200° C. or less, or wherein the composition comprises a nitrogen content of 5.0 wppm or less, or a combination thereof.

Embodiment 7. A distillate boiling range composition comprising a T10 distillation point of 180° C. or more, a T90 distillation point of 370° C. or less, an aromatics content of 40 wt % or more, a sulfur content of between 10 to 1000 wppm, and a weight ratio of aliphatic sulfur to total sulfur of at least 0.15.

Embodiment 8. The composition of Embodiment 7, wherein the composition comprises a paraffins content of 17 wt % or more, or wherein the composition comprises a weight ratio of paraffins to total saturates of 0.7 or more, or a combination thereof.

Embodiment 9. The composition of Embodiment 7 or 8, wherein the composition comprises a BMCI of 50 or more, or wherein the composition comprises a ratio of BMCI to total sulfur of 0.05 or more, or a combination thereof.

Embodiment 10. The composition of any of Embodiments 7-9, wherein the composition comprises 50 wt % to 80 wt % aromatics.

Embodiment 11. The composition of any of Embodiments 7-10, wherein the composition comprises a specific energy of 42.0 MJ/kg or higher.

Embodiment 12. The composition of any of Embodiments 7-11, wherein the composition comprises a cetane rating of 25 or more (or 38 or more).

Embodiment 13. A composition comprising a T10 distillation point of 340° C. or more, a T90 distillation point of 550° C. or less, a sulfur content of 2500 wppm or less, a weight ratio of aliphatic sulfur to total sulfur of 0.15 or more, a saturates content of 20 wt % or more, and an aromatics content of 40 wt % or more.

Embodiment 14. The composition of Embodiment 13, wherein the weight ratio of aliphatic sulfur to total sulfur is 0.20 or more, or wherein the composition comprises a BMCI of 40 or more, or a combination thereof.

Embodiment 15. The composition of Embodiment 13 or 14, wherein the composition comprises a total saturates content of 25 wt % or more, or wherein the composition comprises a nitrogen content of 1000 wppm or less, or a combination thereof.

Embodiment 16. The composition of any of Embodiments 13-15, wherein the composition comprises a No Flow Point of 20° C. or less.

Embodiment 17. A total effluent from an FCC process comprising a combined weight of a naphtha boiling range portion and a distillate boiling range portion of 65 wt % or more, 10 wt % or more of $C_4$ hydrocarbons, and a ratio of $C_3$ olefins to total $C_3$ hydrocarbons of 0.84 or more.

Embodiment 18. The total effluent of Embodiment 17, wherein the total effluent comprises 12 wt % or less of 340° C.+ bottoms.

Embodiment 19. The total effluent of Embodiment 17 or 18, wherein the naphtha boiling range portion comprises 60 wt % or more of the total effluent.

Embodiment 20. The total effluent of any of Embodiments 17-19, wherein the total effluent comprises 1.5 wt % or less of $H_2$, $C_1$ hydrocarbons, and $C_2$ hydrocarbons, or wherein the total effluent comprises a ratio of $C_2$ olefins to total $C_2$ hydrocarbons of 0.54 or more, or a combination thereof.

Embodiment 21. The total effluent of any of Embodiments 17-20, wherein the total effluent comprises a combined weight of the naphtha boiling range portion and the distillate boiling range portion of 72 wt % or more.

Embodiment 22. The total effluent of any of Embodiments 17-21, wherein the naphtha boiling portion comprises a naphtha boiling range composition according to any of Embodiments 1-6.

Embodiment 23. The total effluent of any of Embodiments 17-22, wherein the distillate boiling portion comprises a distillate boiling range composition according to any of Embodiments 7-12.

Embodiment 24. The total effluent of any of Embodiments 18-23, wherein the 340° C.+ bottoms comprises a composition according to any of Embodiments 13-16.

Embodiment 25. A method for performing fluid catalytic cracking, comprising: exposing a feed to a cracking catalyst under fluid catalytic cracking conditions comprising 60 wt % or more conversion relative to 221° C. to form coke and a total effluent, the feed comprising 25 wt % or more of a vacuum gas oil boiling range fraction, wherein the vacuum gas oil boiling range fraction comprises 10 wt % or more of aromatics, a naphthenes to aromatics weight ratio of 1.5 or higher, and a sulfur content of 1200 wppm or less, and wherein the total effluent comprises a naphtha boiling range portion, the naphtha boiling range portion comprising a sulfur content of 30 wppm or less relative to a weight of the naphtha boiling range portion, a ratio of mercaptan sulfur to total sulfur of 0.1 to 0.9, an aromatics content of 10 wt % or more relative to a weight of the naphtha boiling range portion, and a ratio of paraffins to aromatics of 1.0 or more.

Embodiment 26. The method of Embodiment 25, wherein a combined yield of coke, $H_2$, $C_1$ hydrocarbons, and $C_2$ hydrocarbons of 5.0 wt % or less relative to a weight of the feed.

Embodiment 27. The method of Embodiment 25 or 26, wherein the feed comprises an atmospheric resid, the atmospheric resid comprising the 25 wt % or more of the vacuum gas oil boiling range fraction.

Embodiment 28. The method of any of Embodiments 25-27, wherein the naphtha boiling portion comprises a naphtha boiling range composition according to any of Embodiments 1-6.

Embodiment 29. The method of any of Embodiments 25-28, wherein the total effluent comprises a distillate boiling portion, the distillate boiling range portion comprising a distillate boiling range composition according to any of Embodiments 7-12.

Embodiment 30. The method of any of Embodiments 25-29, wherein the total effluent comprises a 340° C.+ bottoms, the 340° C.+ bottoms comprising a composition according to any of Embodiments 13-16.

Additional Embodiment A: Use of a composition comprising a composition according to any of Embodiments 1-6 as a fuel in an engine, a furnace, a burner, a combustion device, or a combination thereof.

Additional Embodiment B: Use of a composition comprising a composition according to any of Embodiments 7-12 as a fuel in an engine, a furnace, a burner, a combustion device, or a combination thereof.

Additional Embodiment C: Use of a composition comprising a composition according to any of Embodiments 13-16 as a fuel in an engine, a furnace, a burner, a combustion device, or a combination thereof.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention. Many alterations, modifications, and variations will be apparent to those skilled in the art in light of the foregoing description without departing from the spirit or scope of the present disclosure and that when numerical lower limits and numerical upper limits are listed herein, ranges from any lower limit to any upper limit are contemplated.

What is claimed is:

1. A naphtha boiling range composition comprising a T90 distillation point of 221° C. or less, an aromatics content of 10 wt % to 23 wt %, a weight ratio of paraffins to aromatics of 1.4 or more, a sulfur content of 30 wppm or less, and a weight ratio of mercaptan sulfur to total sulfur of 0.10 to 0.90.

2. The composition of claim 1, wherein the composition comprises a weight ratio of isoparaffins to aromatics of 1.3 or more.

3. The composition of claim 1, wherein the composition comprises a hydrogen content of 13.3 wt % or more.

4. The composition of claim 1, wherein the composition comprises a research octane number (RON) of 85 or more.

5. The composition of claim 1, wherein the composition comprises a research octane number (RON) of 89 or more, or wherein the composition comprises a (RON+MON)/2 value of 85 or more, or a combination thereof.

6. The composition of claim 1, wherein the composition comprises a T90 distillation point of 200° C. or less.

7. The composition of claim 1, wherein the composition comprises a nitrogen content of 5.0 wppm or less.

8. A total effluent from an FCC process comprising a combined weight of a naphtha boiling range portion and a distillate boiling range portion of 65 wt % or more relative to a weight of the total effluent, 10 wt % or more of $C_4$ hydrocarbons relative to the weight of the total effluent, and a ratio of $C_3$ olefins to total $C_3$ hydrocarbons of 0.84 or more, wherein the naphtha boiling range portion comprises a T90 distillation point of 221° C. or less, an aromatics content of 10 wt % to 23 wt % relative to a weight of the naphtha boiling range portion, a weight ratio of paraffins to aromatics of 1.4 or more, a sulfur content of 30 wppm or less, and a weight ratio of mercaptan sulfur to total sulfur of 0.10 to 0.90.

9. The total effluent of claim 8, wherein the total effluent comprises 12 wt % or less of 340° C.+ bottoms.

10. The total effluent of claim 8, wherein the naphtha boiling range portion comprises 60 wt % or more of the total effluent.

11. The total effluent of claim 8, wherein the total effluent comprises 1.5 wt % or less of $H_2$, $C_1$ hydrocarbons, and $C_2$ hydrocarbons.

12. The total effluent of claim 8, wherein the total effluent comprises a combined weight of the naphtha boiling range portion and the distillate boiling range portion of 72 wt % or more.

13. The total effluent of claim 8, wherein the total effluent comprises a ratio of $C_2$ olefins to total $C_2$ hydrocarbons of 0.54 or more.

14. A method for performing fluid catalytic cracking, comprising:

exposing a feed to a cracking catalyst under fluid catalytic cracking conditions comprising 60 wt % or more conversion relative to 221° C. to form coke and a total effluent, the feed comprising 25 wt % or more of a vacuum gas oil boiling range fraction, wherein the vacuum gas oil boiling range fraction comprises 10 wt % or more of aromatics, a naphthenes to aromatics weight ratio of 1.5 or higher, and a sulfur content of 1200 wppm or less, and wherein the total effluent comprises a naphtha boiling range portion, the naphtha boiling range portion comprising a sulfur content of 30 wppm or less relative to a weight of the naphtha boiling range portion, a ratio of mercaptan sulfur to total sulfur of 0.1 to 0.9, an aromatics content of 10 wt % or more relative to a weight of the naphtha boiling range portion, and a weight ratio of paraffins to aromatics of 1.0 or more.

15. The method of claim 14, wherein a combined yield of coke, $H_2$, $C_1$ hydrocarbons, and $C_2$ hydrocarbons of 5.0 wt % or less relative to a weight of the feed.

16. The method of claim 14, wherein the feed comprises an atmospheric resid, the atmospheric resid comprising the 25 wt % or more of the vacuum gas oil boiling range fraction.

* * * * *